US008298015B2

(12) United States Patent
Cohen et al.

(10) Patent No.: US 8,298,015 B2
(45) Date of Patent: Oct. 30, 2012

(54) ELECTRICAL CONNECTOR ASSEMBLY WITH IMPROVED SHIELD AND SHIELD COUPLING

(75) Inventors: Thomas S. Cohen, New Boston, NH (US); Brian P. Kirk, Amherst, NH (US); John R. Dunham, Windham, NH (US)

(73) Assignee: Amphenol Corporation, Wallingford, CT (US)

( * ) Notice: Subject to any disclaimer, the term of this patent is extended or adjusted under 35 U.S.C. 154(b) by 552 days.

(21) Appl. No.: 12/249,608

(22) Filed: Oct. 10, 2008

(65) Prior Publication Data

US 2010/0093216 A1 Apr. 15, 2010

(51) Int. Cl.
*H01R 13/648* (2006.01)

(52) U.S. Cl. ..... 439/607.1; 439/856

(58) Field of Classification Search ..... 439/607.06–607.11, 856

See application file for complete search history.

(56) References Cited

U.S. PATENT DOCUMENTS

| | | | | |
|---|---|---|---|---|
| 3,669,054 | A * | 6/1972 | Desso et al. | 29/874 |
| 6,247,970 | B1 | 6/2001 | Ueno et al. | |
| 6,250,942 | B1 | 6/2001 | Lemke et al. | |
| 6,409,543 | B1 | 6/2002 | Astbury, Jr. et al. | |
| 6,506,076 | B2 | 1/2003 | Cohen et al. | |
| 6,551,140 | B2 * | 4/2003 | Billman et al. | 439/607.07 |
| 6,592,381 | B2 | 7/2003 | Cohen et al. | |
| 6,602,095 | B2 | 8/2003 | Astbury, Jr. et al. | |
| 6,709,294 | B1 | 3/2004 | Cohen et al. | |
| 6,780,054 | B2 | 8/2004 | Yip et al. | |
| 6,872,085 | B1 | 3/2005 | Cohen et al. | |
| 7,094,102 | B2 | 8/2006 | Cohen et al. | |
| 7,108,556 | B2 | 9/2006 | Cohen et al. | |
| 7,285,018 | B2 | 10/2007 | Kenny et al. | |
| 7,320,621 | B2 * | 1/2008 | Laurx et al. | 439/607.11 |
| 7,621,779 | B2 * | 11/2009 | Laurx et al. | 439/607.07 |
| 2004/0264153 | A1 | 12/2004 | Payne et al. | |
| 2005/0283974 | A1 | 12/2005 | Richard et al. | |
| 2007/0042639 | A1 | 2/2007 | Manter et al. | |
| 2007/0054554 | A1 | 3/2007 | Do et al. | |
| 2007/0059961 | A1 | 3/2007 | Cartier et al. | |
| 2007/0149057 | A1 | 6/2007 | Cohen et al. | |

* cited by examiner

*Primary Examiner* — Felix O Figueroa
(74) *Attorney, Agent, or Firm* — Blank Rome LLP

(57) ABSTRACT

An electrical connector provides shielded signal pathways. The electrical connector includes a shield plate, a first finger that extends from an edge of the shield plate, and a second finger that extends from the edged of the shield and that is adjacent to the first finger. A channel is formed between the first finger and the second finger. A coupling is placed within the channel adjacent the first finger. The coupling includes a contact, a first connecting arm extending from a first end of the contact to a first portion of the first finger, and a second connecting arm extending from a second end of the contact to a second portion of the first finger. The first connecting arm and the second connecting arm provide at least two current paths from the contact to the first finger.

24 Claims, 20 Drawing Sheets

ELECTRICAL CONNECTOR ASSEMBLY WITH IMPROVED SHIELD AND SHIELD COUPLING

FIELD OF THE INVENTION

The present invention is related to electrical connector assemblies. In particular, the present invention is related to high-speed, high-density electrical connector assemblies for interconnecting two or more circuit boards.

BACKGROUND OF THE INVENTION

To simplify manufacturing and reduce overall costs, an electronic system is generally manufactured on separate printed circuit boards. These separate printed circuit boards are then connected to one another by electrical connectors. Typically, one printed circuit board serves as a backplane. Then other printed circuit boards, which are often called daughter boards or daughter cards, are connected to the backplane by electrical connectors to form the electronic system.

To meet demands for electronic systems that are more compact, faster, and more complex, progressively more circuits are placed within a given area of each printed circuit board, and those additional circuits operate at increasingly higher frequencies. Therefore, the electrical connectors between the printed circuit boards have to pass data at increasingly higher rates and higher signal frequencies. For faster data processing, current electronic systems require faster data transmission between printed circuit boards.

Because of the increasing signal frequencies, electrical connectors encounter more electrical noise. The electrical noise often manifests itself as signal reflections, crosstalk, electromagnetic radiation, or other similar forms of electrical noise. Signal reflection occurs when a portion of a signal being transmitted is reflected back to the signal source instead of being transmitted to the signal destination. Signal reflections are caused by signal path imperfections that give rise to impedance mismatching. Also, changes in the signal path characteristics, particularly abrupt changes, can cause signals to be reflected.

Crosstalk is electromagnetic coupling of one signal path with another signal path. The coupling results in one signal affecting another nearby signal. To reduce electrical noise in the form of crosstalk, signal paths are arranged so that the signal paths are spaced farther apart from each other and nearer to a shield plate which is generally the ground plate or a conductor connected to ground, such as described in U.S. Patent Application Pub. No. 2004/0264153 to Payne et al., entitled "Printed Circuit Board for High Speed, High Density Electrical Connector with Improved Cross-Talk Minimization, Attenuation and Impedance Mismatch Characteristics," which is incorporated by reference herein in its entirety. Therefore, the signal paths tend to couple electromagnetically more with the shield plate or ground conductor and less with each other. For a particular level of crosstalk, the signal paths can be placed closer to each other as long as sufficient electromagnetic coupling to the shield plate or a ground conductor is maintained.

Also, in a region where the signal path electrically connects to another circuit, manufacturing costs are relatively higher since the signal path must be formed and shaped to provide an acceptable electrical connection that is mechanically durable. Such connections are typically more difficult to manufacture because a more complicated shape is required and complicated shapes are more costly to form. The connections also need electromagnetic coupling to the shield plate or to ground conductors to minimize crosstalk.

An electrical connector is described in U.S. Pat. No. 6,409,543 Astbury, Jr. et al., entitled "Connector Molding Method and Shielded Waferized Connector Made Therefrom," the entire disclosure of which is incorporated herein by reference. The electrical connector is assembled from wafers, and each wafer is formed by molding a dielectric housing over a shield plate. Signal conductors are inserted into the dielectric housing. A mating contact region is provided near an edge of the wafer where the signal conductors mate with a backplane connector. In the mating contact region, the signal conductors mate with the signal contacts of the backplane connector. Provided near the edge of the wafer are shield beam contacts. The shield beam contacts are connected to the shield plate and engage an upper edge of the shield plate in the backplane connector that forms a current path to reduce crosstalk. However, the shield beam contact provides only a single current path to reduce electromagnetic coupling and crosstalk, and a substantial amount of the shield plate is not utilized, thereby diminishing the effectiveness of the shield plate.

Another approach to provide shielding between adjacent connections and to reduce costs is to use plastic containing conductive materials, such as the connector described in U.S. Patent Application Pub. No. 2007/0042639 to Manter et al., entitled "Connector with Inproved Shielding in Mating Contact Region," which is incorporated by reference herein in its entirety. However, the use of plastic containing conductive materials between signal paths does not provide the stiffness, the shielding, and the lower relative manufacturing cost of using a metal shield.

Therefore, there is a need in the art for a high speed, high density electrical connector design that minimizes crosstalk, provides increased conductive metal content around the contact region, and lowers manufacturing costs.

SUMMARY OF THE INVENTION

Accordingly, one object of the invention is to provide additional current paths between two or more shields. Another object of the invention is to provide an electrical connector assembly. Yet another object of the invention is to minimize crosstalk. A further object of the invention is to maximize the use of the shield.

One embodiment of the invention provides an electrical connector. The electrical connector includes a shield plate, a first finger that extends from an edge of the shield plate, and a second finger that extends from the edged of the shield and that is adjacent to the first finger. A channel is formed between the first finger and the second finger. A coupling is placed within the channel adjacent the first finger. The coupling includes a contact, a first connecting arm extending from a first end of the contact to a first portion of the first finger, and a second connecting arm extending from a second end of the contact to a second portion of the first finger. The first connecting arm and the second connecting arm provide at least two current paths from the contact to the first finger.

Another embodiment of the invention provides an electrical connector. The electrical connector includes a first wafer and a second wafer placed adjacent the first wafer. The first wafer has a first shield plate, first shield couplings in pairs along an edge of the first shield plate to form a first column of first shield couplings, and first signal conductors adjacent the first shield plate between respective pairs of first shield couplings. The second wafer has a second shield plate, second shield couplings along an edge of the second shield plate to form a second column of second shield couplings parallel to the first column of first shield couplings, and second signal conductors in pairs adjacent the second shield plate. At least one of the pair of first shield couplings is adjacent to one of the first signal conductors and at least one of the second signal conductors. Also, at least one of the second shield couplings is adjacent to one of the second signal conductors and at least one of the first signal conductors.

Yet another embodiment of the invention provides an electrical connector assembly. The electrical connector assembly includes a first wafer and a second wafer adjacent the first wafer. The first wafer has a first shield plate, a first finger extending from an edge of the first shield plate, a second finger adjacent to the first finger and extending from the edge of the first shield plate. A first channel is formed between the first finger and the second finger, and a first coupling is within the first channel adjacent the first finger. The first coupling includes a first contact, a first connecting arm extending from a first end of the first contact to a first portion of the first finger, and a second connecting arm extending from a second end of the first contact to a second portion of the first finger. The first connecting arm and the second connecting arm provide at least two current paths from the first contact to the first finger. The second wafer has a second shield plate, a third finger extending from an edge of the second shield plate, and a fourth finger adjacent to the third finger and extending from the edge of the second shield plate. A second channel is formed between the third finger and the fourth finger, and a second coupling is within the second channel adjacent the third finger. The second coupling includes a second contact, a third connecting arm extending from a first end of the second contact to a first portion of the third finger, and a fourth connecting arm extending from a second end of the second contact to a second portion of the third finger. The third connecting arm and the fourth connecting arm provide at least two current paths from the second contact to the third finger. The electrical connector assembly also has a third shield received in the first channel and the second channel where the third shield engages the first contact and the second contact. The electrical connector assembly further includes a fourth shield disposed substantially transverse to the third shield.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
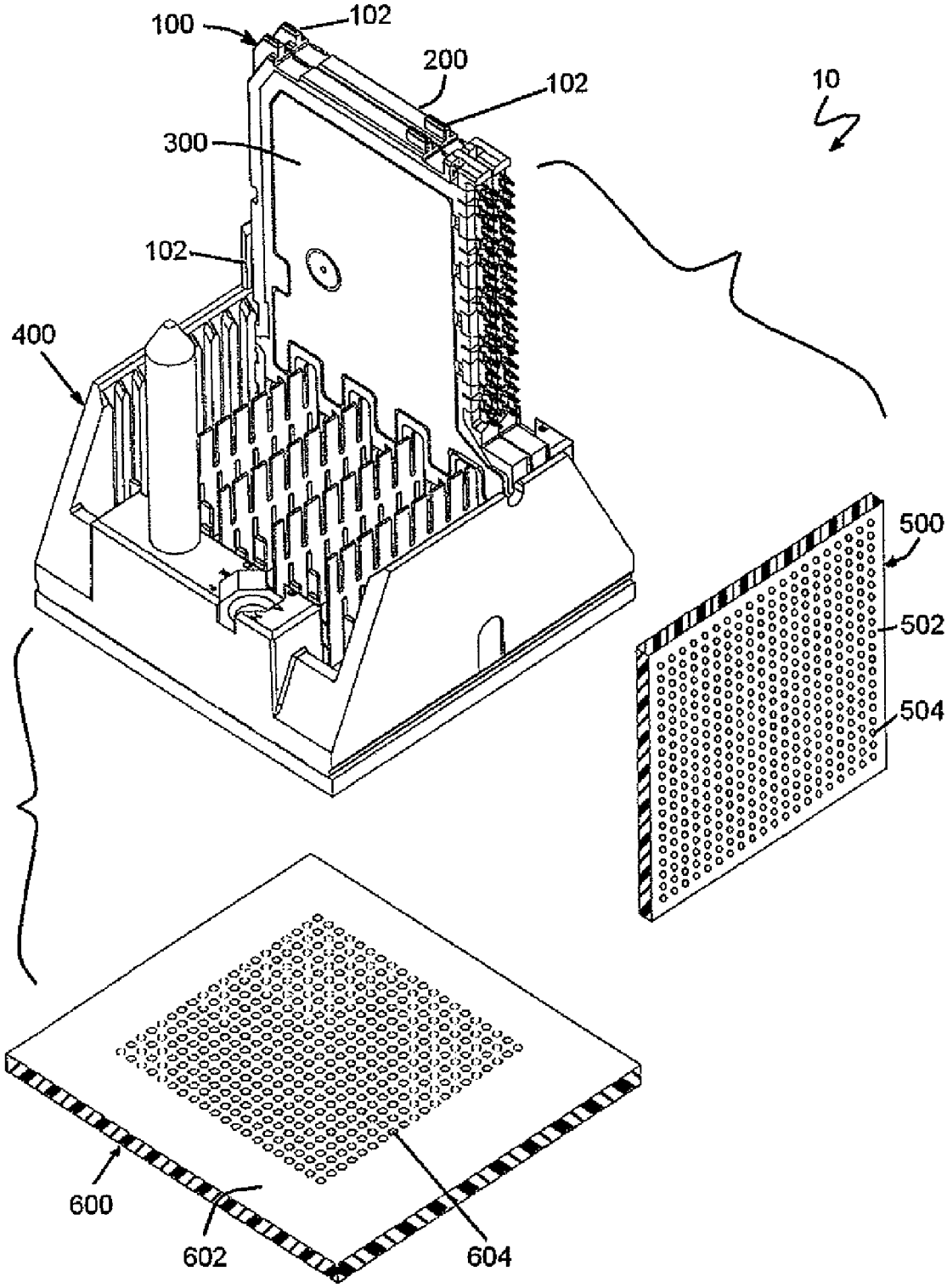
FIG. 1 is an exploded perspective view of an electrical connector assembly in accordance with an exemplary embodiment of the invention.
Figure 2:
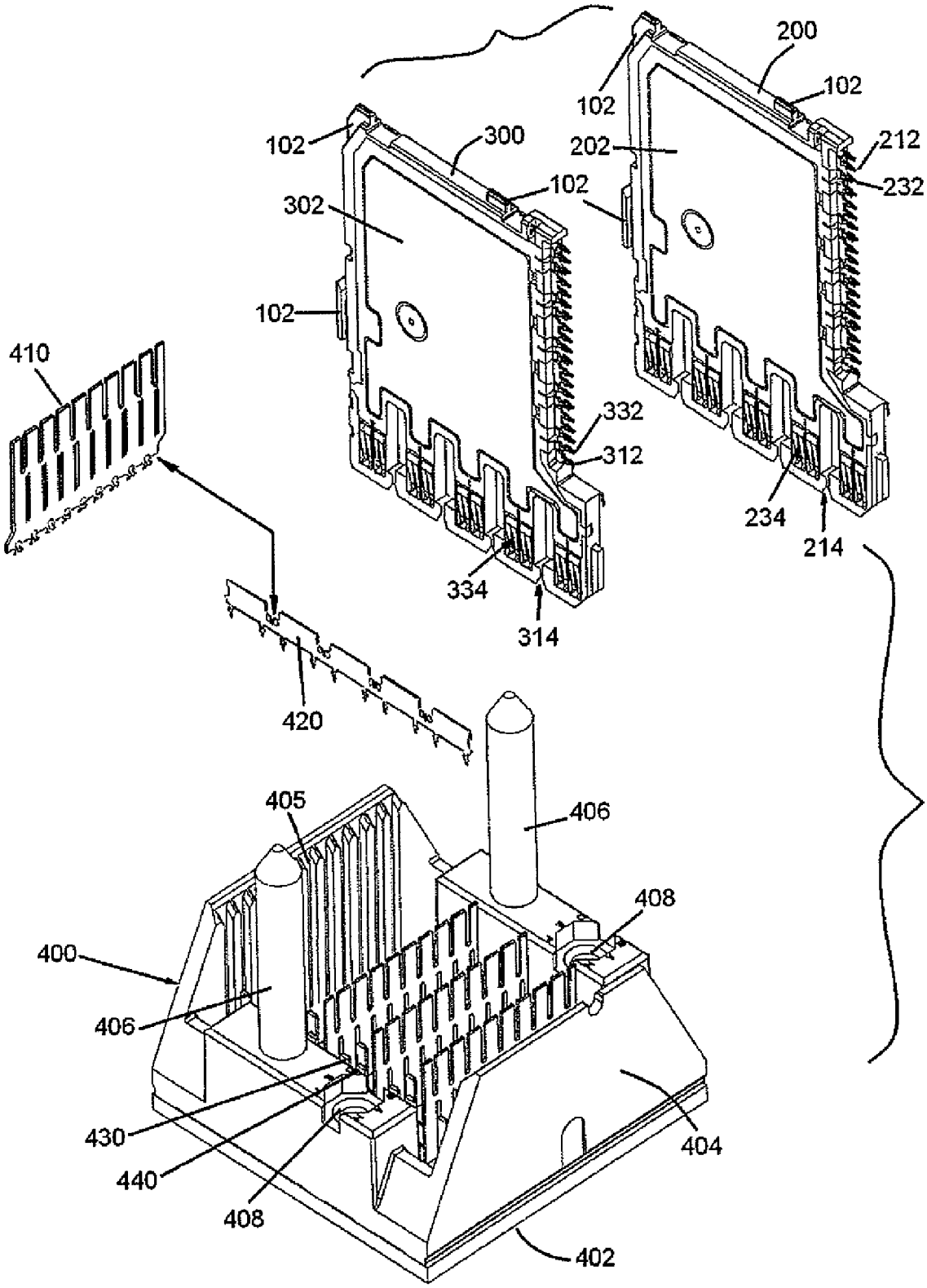
FIG. 2 is an exploded perspective view of a first electrical connector and a second electrical connector of the electrical connector assembly illustrated in FIG. 1.
Figure 4:
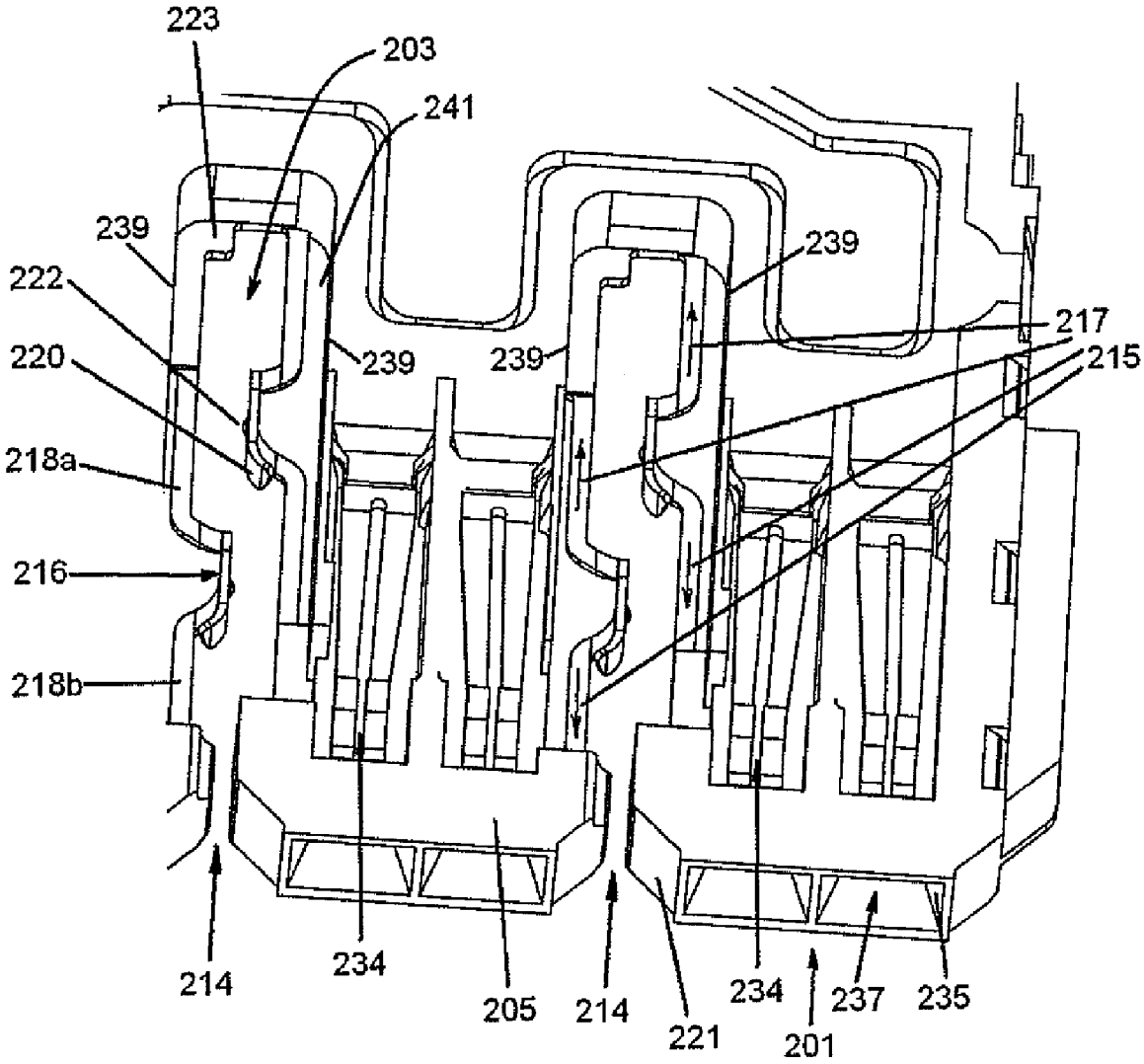
FIG. 4 is a partial perspective view in greater detail of the first wafer illustrated in FIG. 2.
Figure 5:
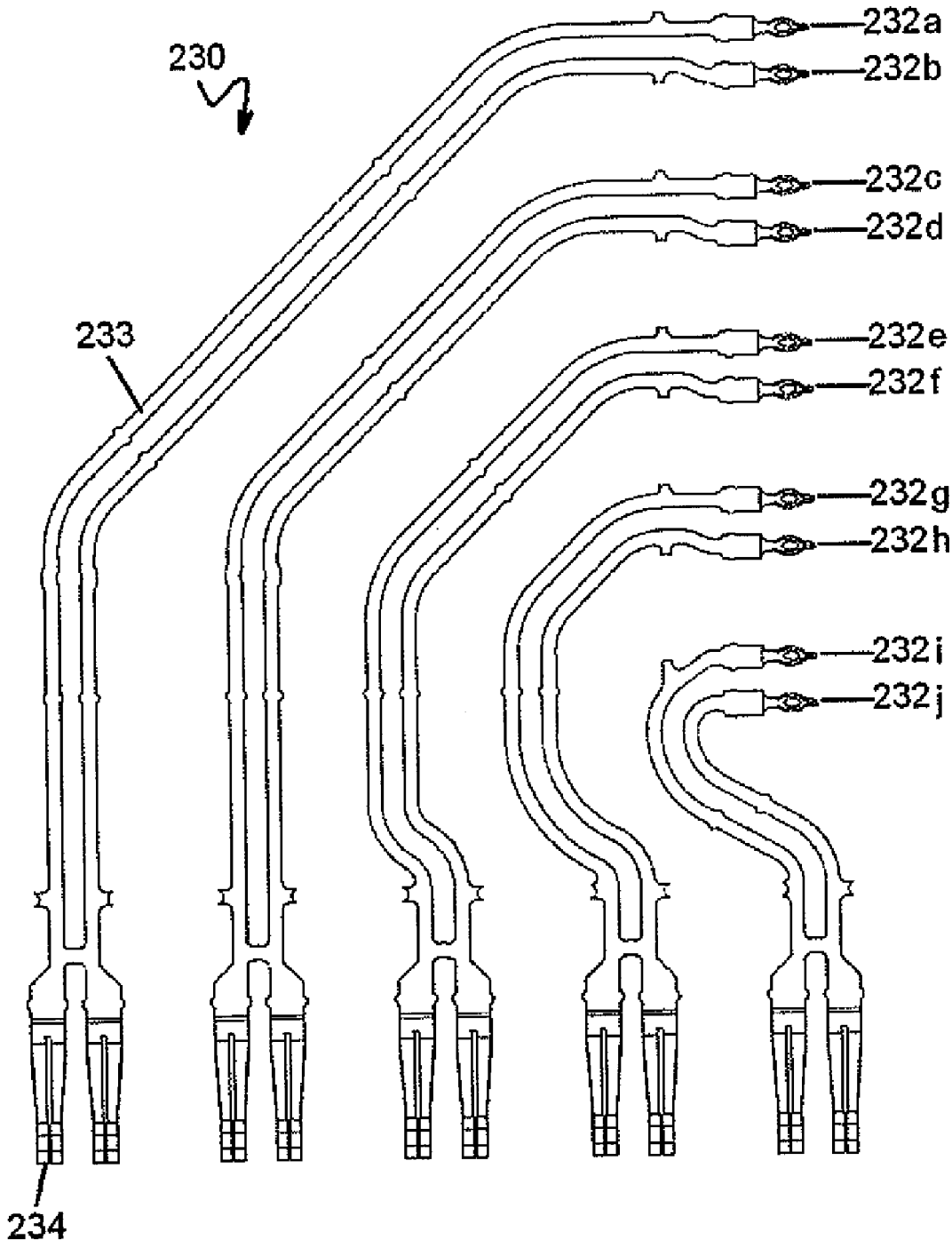
FIG. 5 is a front elevational view of first signal conductors of the first wafer illustrated in FIG. 2.
Figure 6:
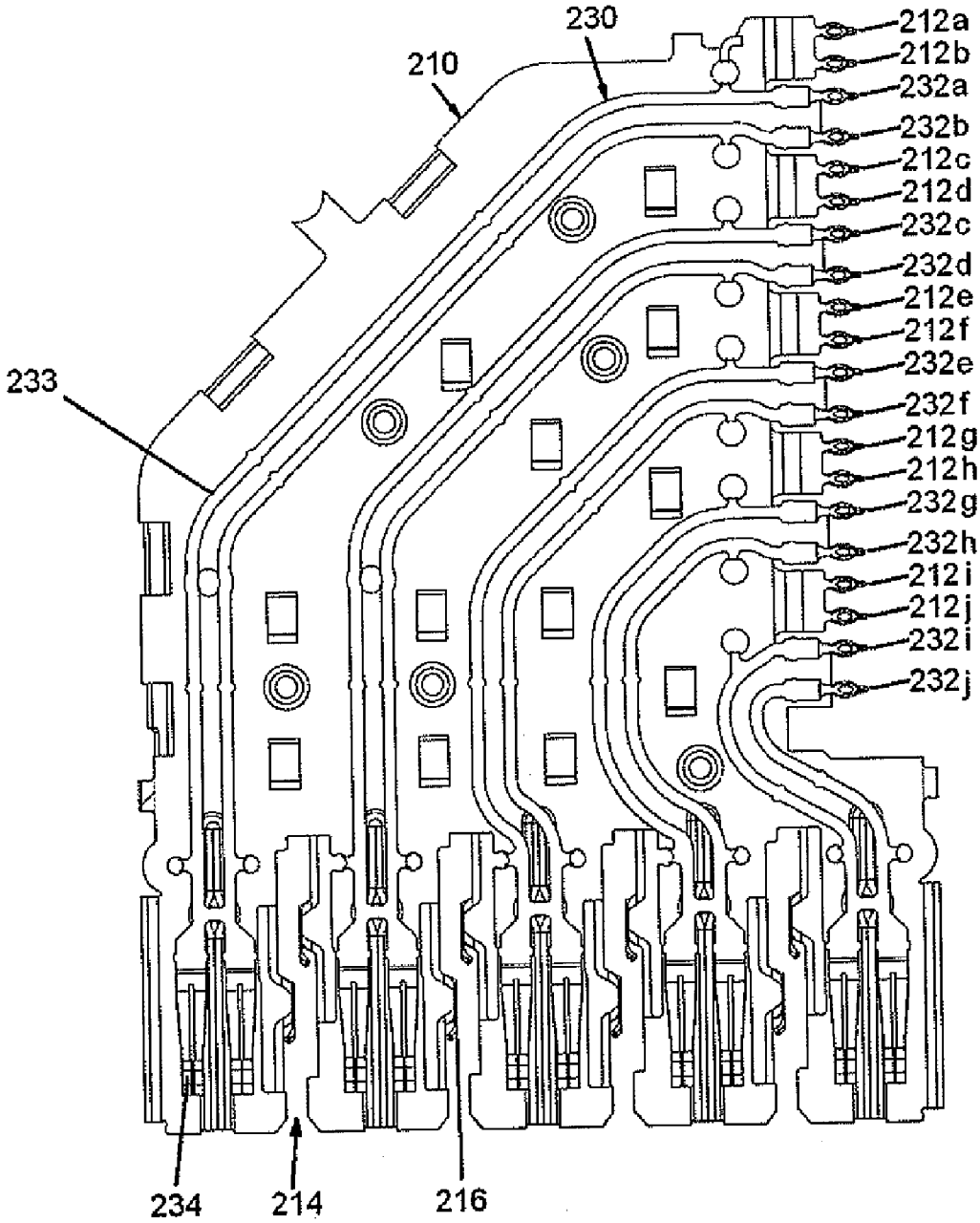
FIG. 6 is a front elevational view of the first shield plate and the first signal conductors of the first connector illustrated in FIG. 2.
Figure 8:
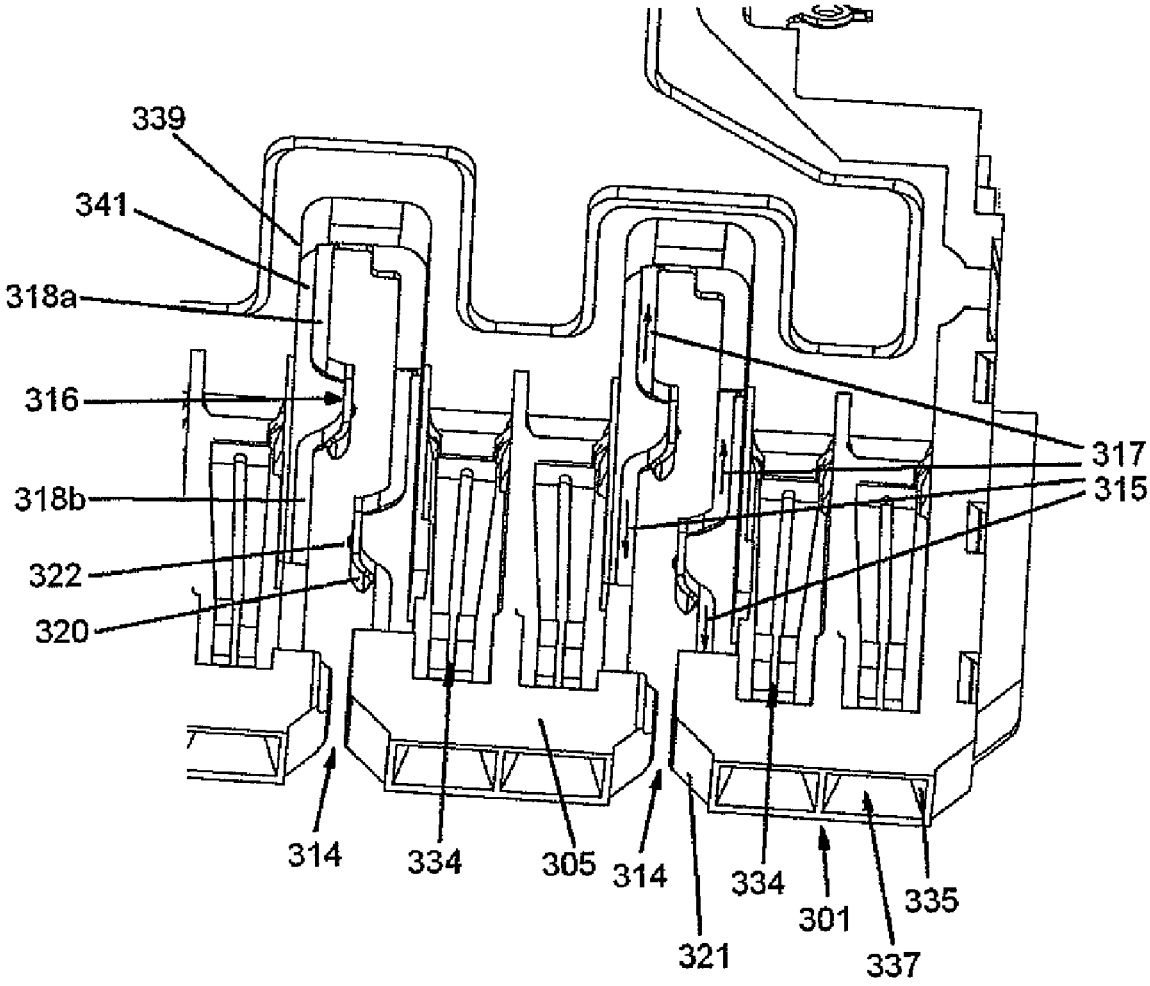
FIG. 8 is a partial perspective view in greater detail of the second wafer illustrated in FIG. 2.
Figure 9:
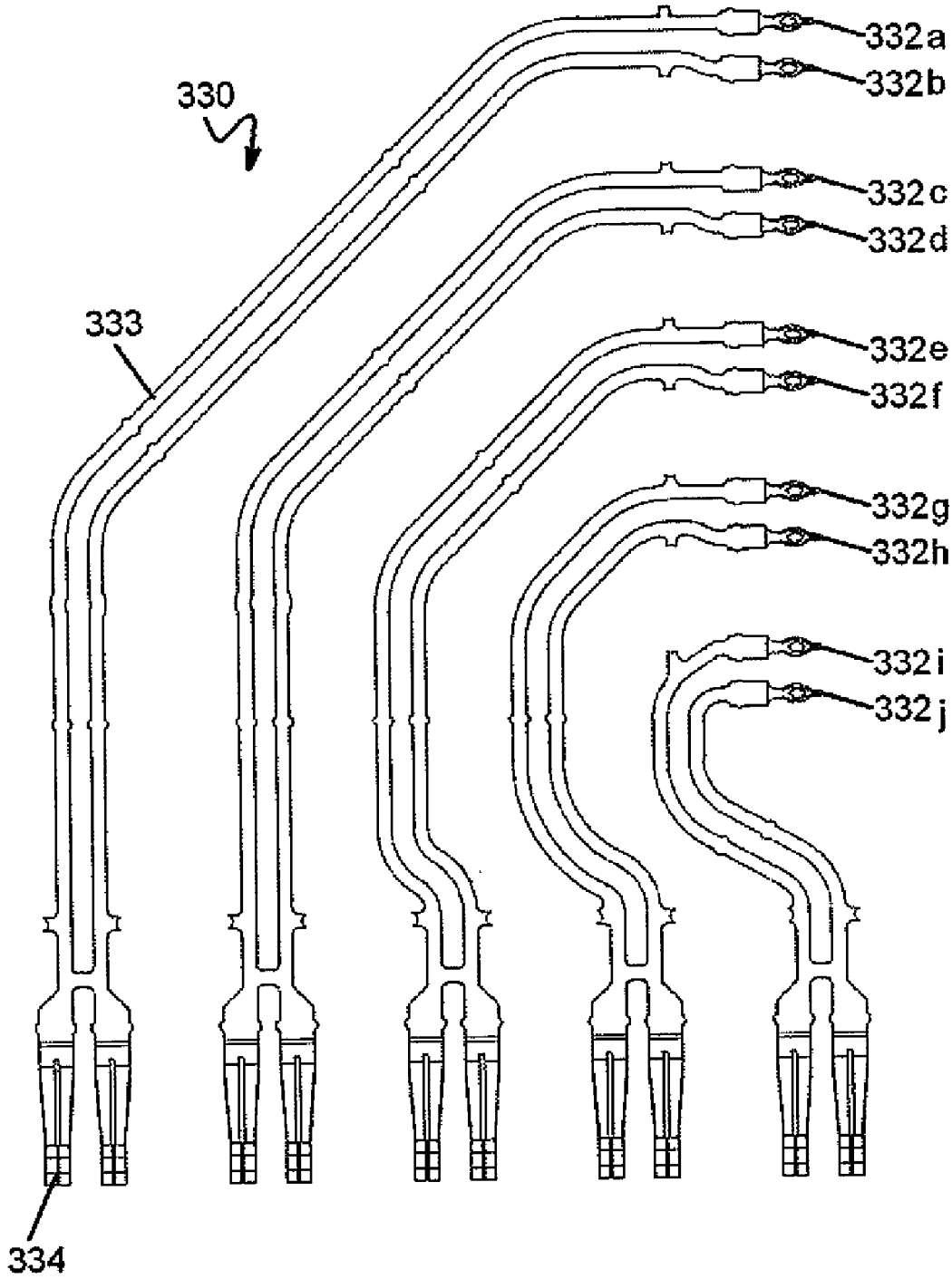
FIG. 9 is a front elevational view of second signal conductors of the second wafer illustrated in FIG. 2.
Figure 10:
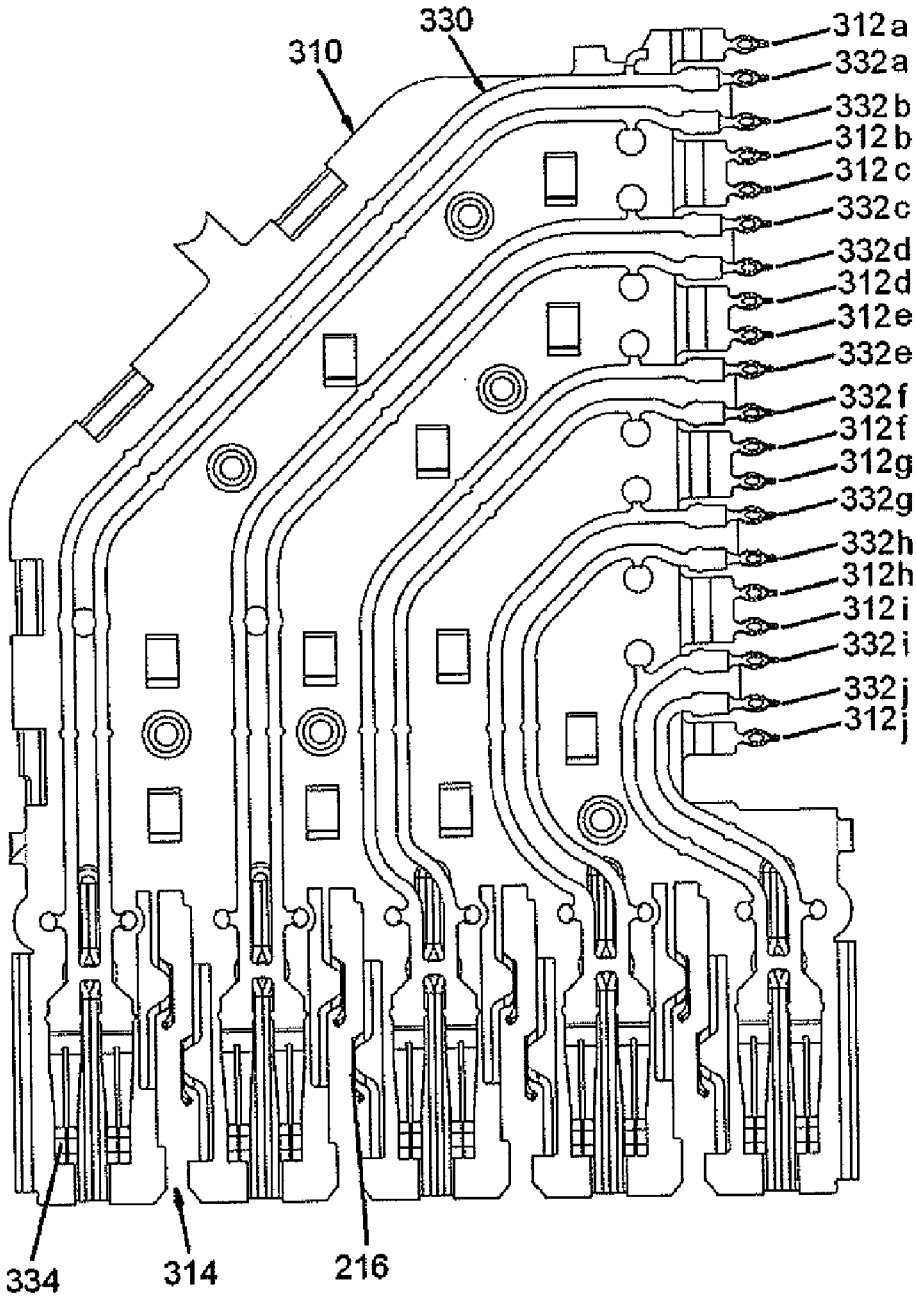
FIG. 10 is a front elevational view of the second shield plate and the second signal conductors of the second connector illustrated in FIG. 2.
Figure 11:
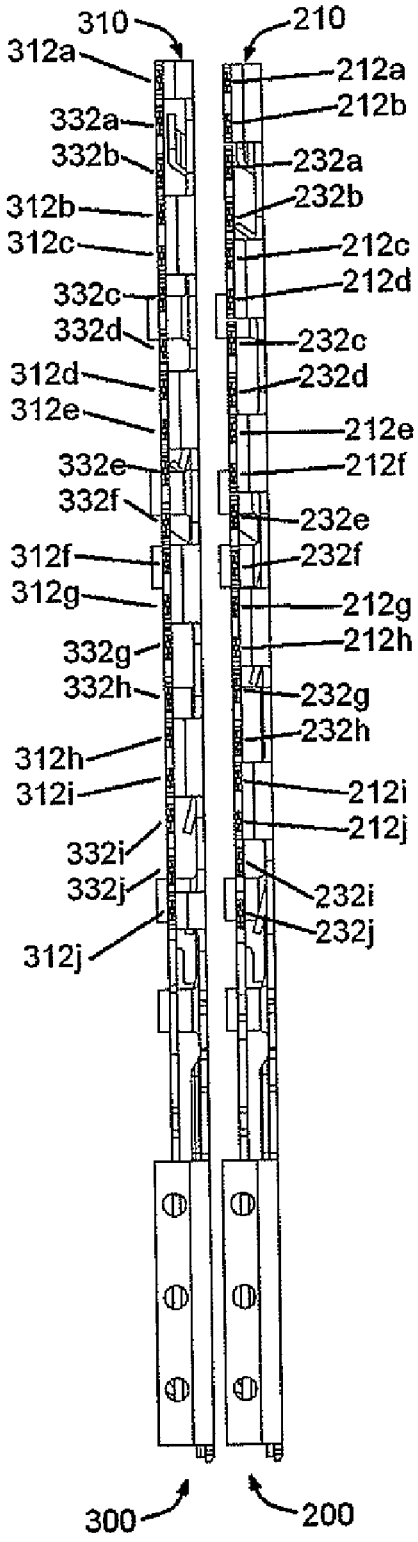
FIG. 11 is a side elevational view of the first and second wafers illustrated in FIG. 2 without insulative bodies.
Figure 13:
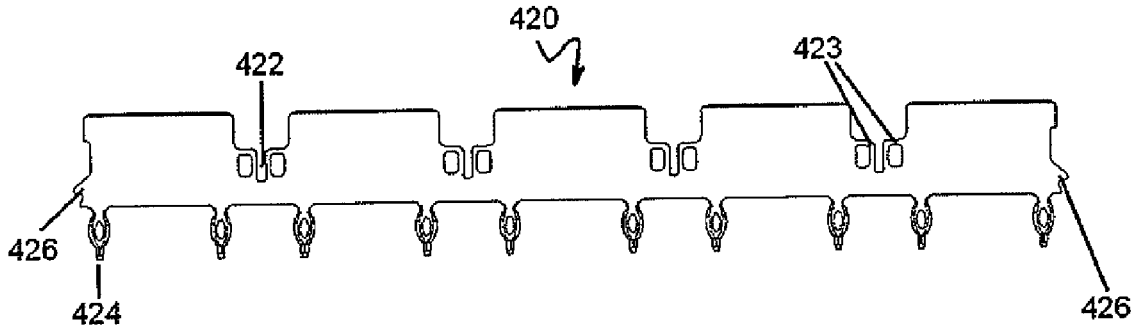
FIG. 13 is a front elevational view of a fourth shield of the second connector illustrated in FIG. 2.
Figure 14:
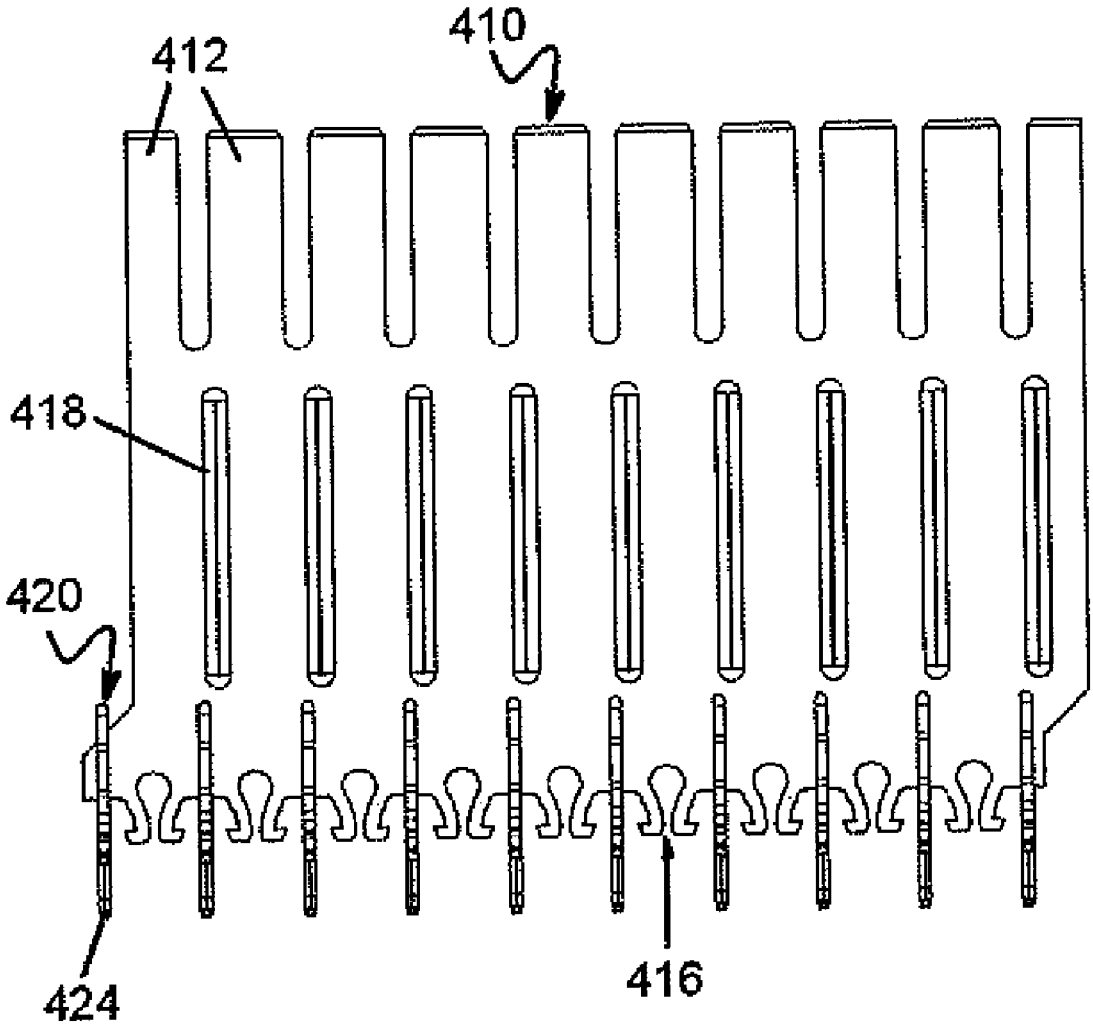
FIG. 14 is a side elevational view of the third and fourth shields illustrated in FIG. 2.
Figure 19:
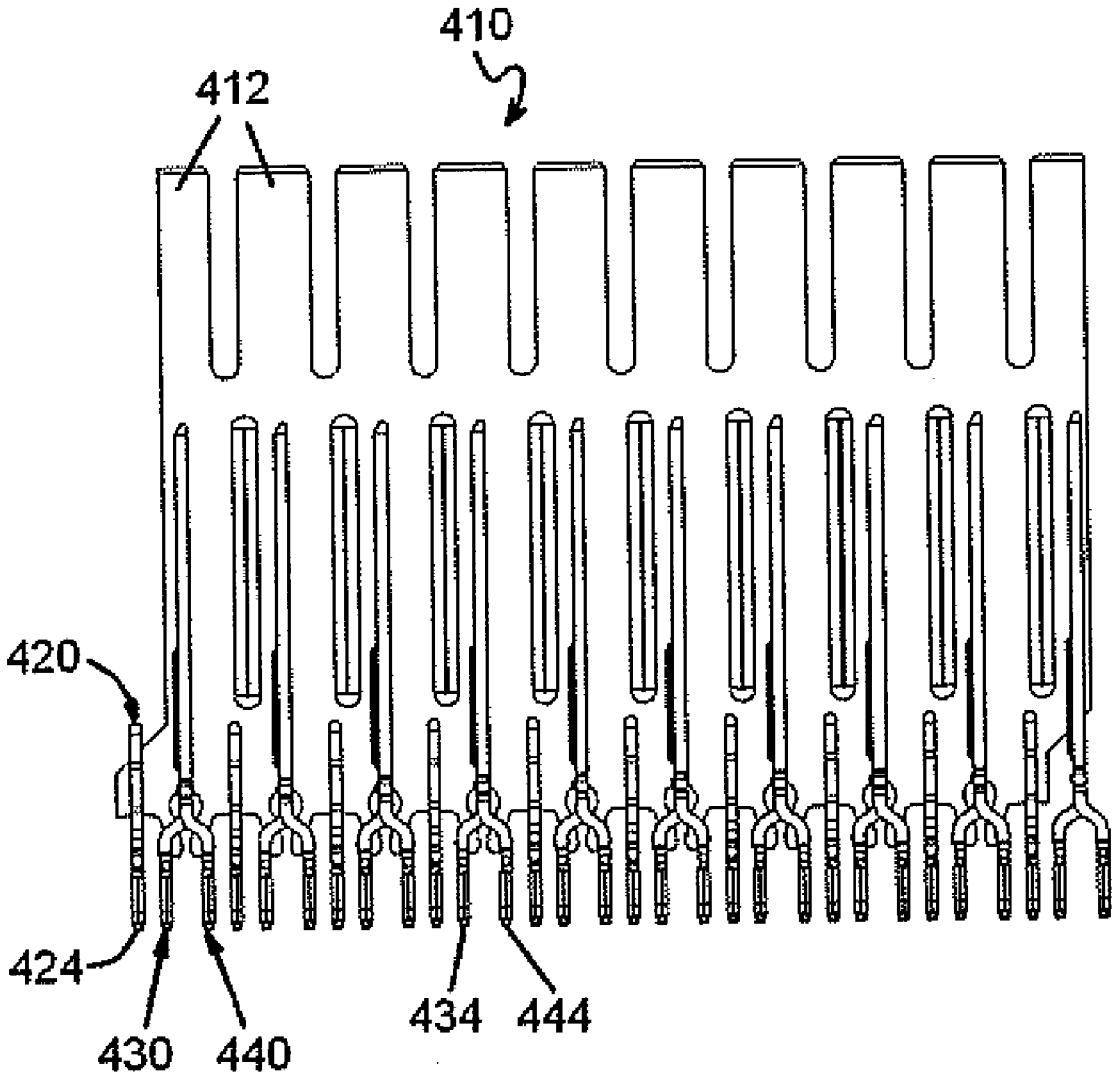
FIG. 19 is a side elevational view of the third shield, the fourth shield, the third signal conductor, and the fourth signal conductor of the second connector illustrated in FIG. 2.
Figure 20:
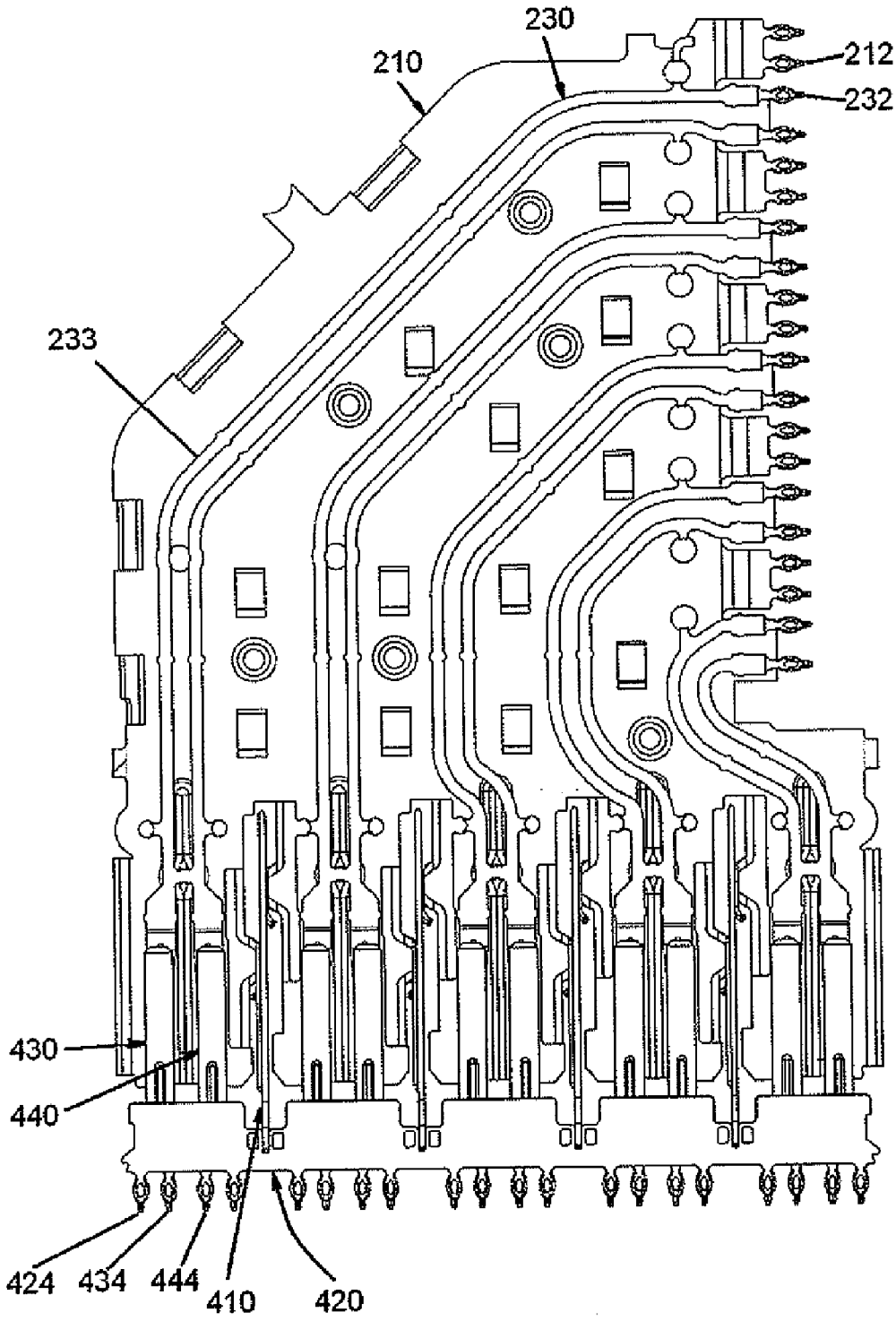
FIG. 20 is a front elevational view of the first shield plate and the first signal conductor of the first connector and the third shield, the fourth shield, the third signal conductor, and the fourth signal conductor of the second connector illustrated in FIG. 2.
Figure 21:
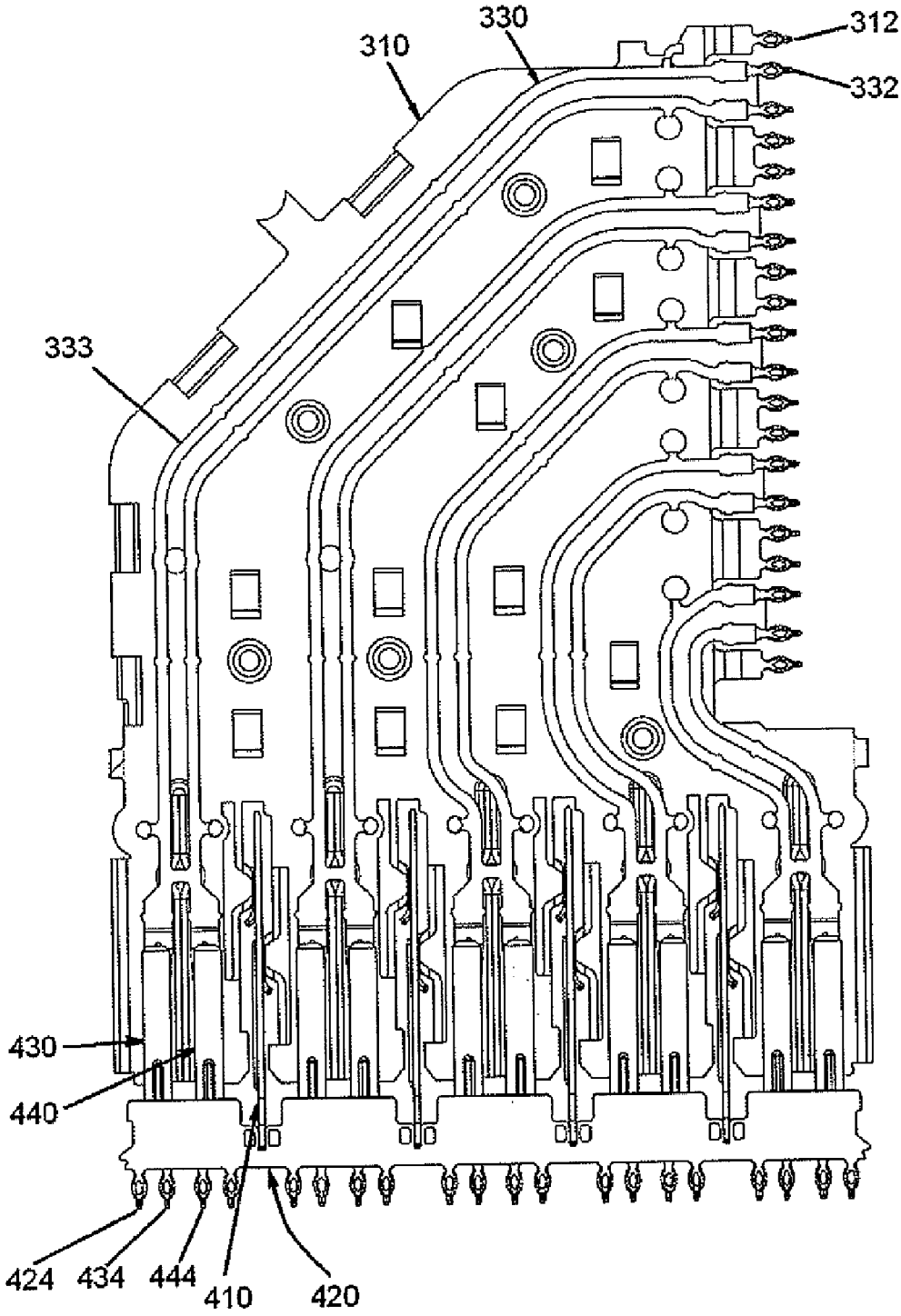
FIG. 21 is a front elevational view of the second shield plate and the second signal conductor of the first connector and the third shield, the fourth shield, the third signal conductor, and the fourth signal conductor of the second connector illustrated in FIG. 2.
Figure 22:
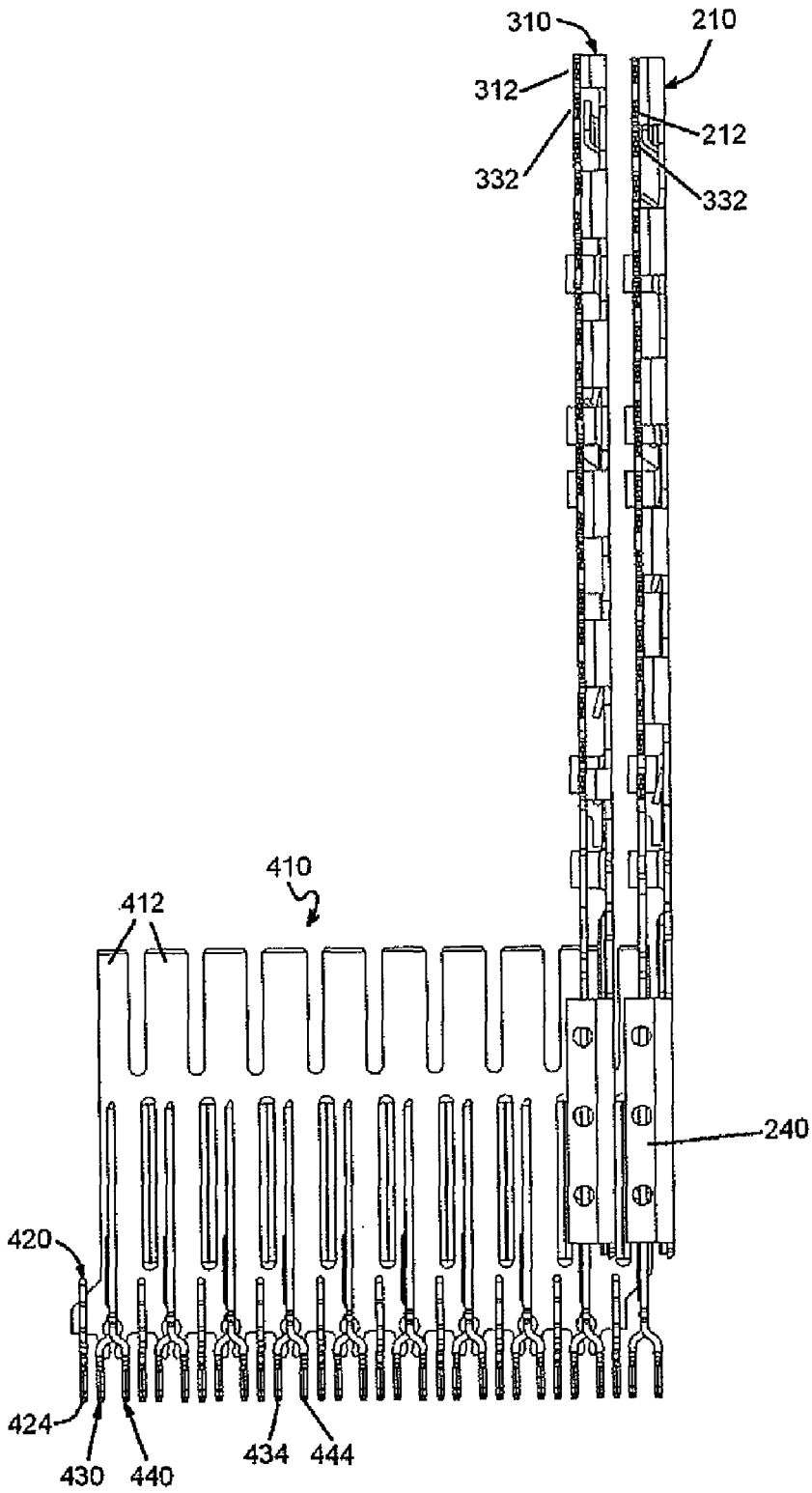
FIG. 22 is a side elevational view of the first shield plate and second shield plate of the first connector and the third shield, fourth shield, the third signal conductor, and the fourth signal conductor of the second connector illustrated in FIG. 2.
Figure 23:
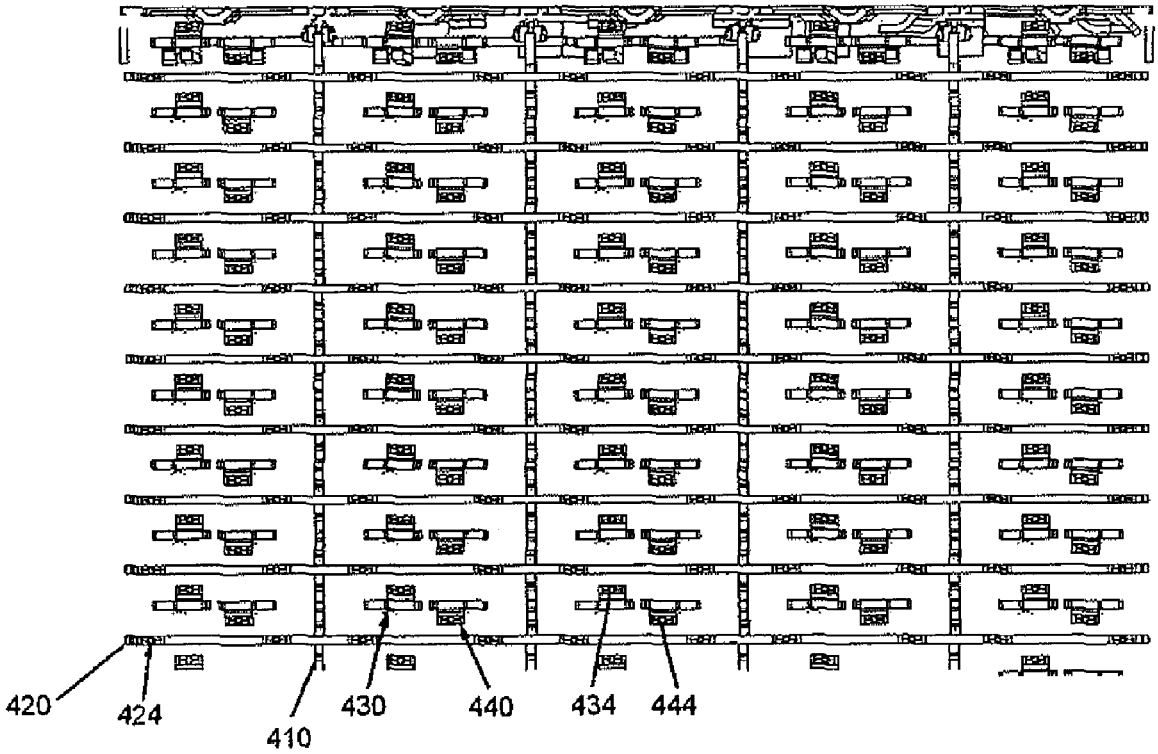
FIG. 23 is a bottom plan view of the second connector illustrated in FIG. 2.
Figure 24:
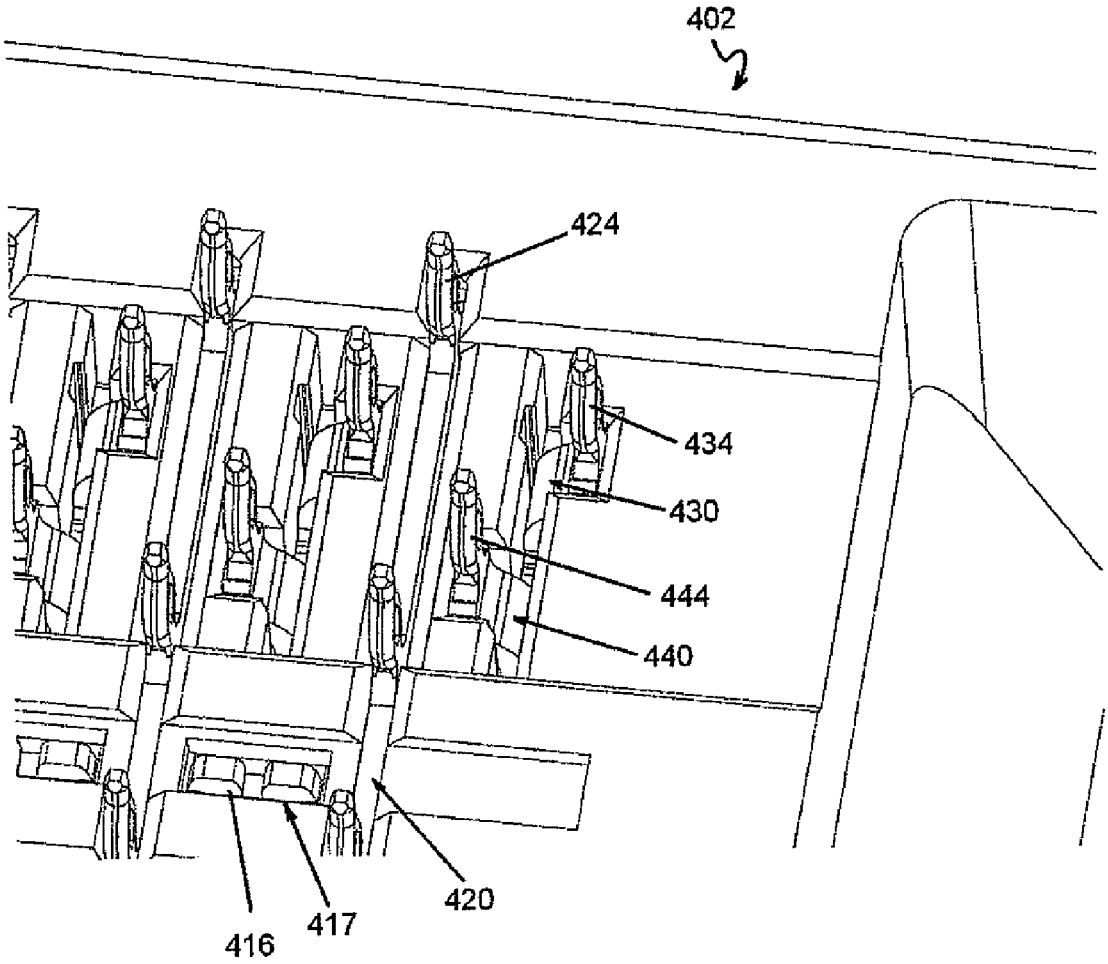
FIG. 24 is a partial bottom perspective view of the second connector illustrated in FIG. 2.

As shown in FIGS. 1-24, the invention provides an electrical connector assembly 10 that has shielded, conductive pathways between a first circuit board 500 and a second circuit board 600. FIG. 1 shows the electrical connector assembly 10 and portions of the first and second circuit boards 500 and 600. The first connector 100 and a second connector 400 couple to each other and to the first and second circuit boards 500 and 600, respectively. FIG. 2 shows that the first connector 100 includes a first wafer 200 and a second wafer 300 and that the second connector 400 includes a third shield 410 (FIGS. 12 and 14) and a fourth shield 420 (FIGS. 13 and 14). Each of the first wafers 200 has a first shield plate 210 (FIGS. 3 and 10) and first signal conductors 230 (FIGS. 5 and 6). Each of the second wafers 300 has a second shield plate 310 (FIGS. 7 and 10) and second signal conductors 330 (FIGS. 9 and 10). FIG. 4 shows a bottom edge portion of the first wafer 200 where the first wafer 200 couples with the third shield 410 in greater detail, and FIG. 8 shows a portion of the second wafer 300 where the second wafer 300 couples with the third shield 410 in greater detail. FIG. 11 shows the first and second shield plates 210 and 310 and the first and second signal conductor pairs 230 and 330 aligned side-by-side with each other in the position they have when inserted into the second connector 400. FIGS. 15-18 show a third signal conductor 430 and a fourth signal conductor 440 of the second connector 400 shown in FIG. 2. FIG. 19 shows the positions of the third and fourth shields 410 and 420 and the third and fourth signal conductors 430 and 440 relative to each other within the second connector 400. FIGS. 20-22 show the relative positions of the first and second shield plates 210 and 310, the first and second signal conductor pairs 230 and 330, the third and fourth shields 420 and 430, and the third and fourth signal conductors 430 and 440 within the first and second connectors 100 and 400. FIG. 23 shows a footprint of the second connector 400, and FIG. 24 shows a bottom surface 402 of the second connector 400.

Referring back to FIG. 1, the electrical connector assembly 10 includes a first connector 100 adapted to couple to a first circuit board 500 and a second connector 400, sometimes referred to as a shroud or a housing, adapted to couple to a second circuit board 600. The first and second connectors 100 and 400 are adapted to couple to each other. The first and second connectors 100 and 400 provide shielded, conductive pathways to electrically couple the first circuit board 500 and the second circuit board 600. Thus, the first circuit board 500 is coupled to the first connector 100, the first connector 100 is coupled to the second connector 400, and the second connector 400 is coupled to the second circuit board 600. Shielded, conductive pathways are formed between the first and second circuit boards 500 and 600, and a signal can be transmitted from the first circuit board 500 to the second circuit board 600 or vice versa through the first and second connectors 100 and 400.

The first circuit board 500 provides a surface 502 for electrical components and their interconnections. The surface 502 is preferably made of a dielectric material, and the first circuit board 500 can have more than one surface 502. If the first circuit board 500 has several surfaces 502, the electrical components on different surfaces 502 can be interconnected by vias, as described in co-pending U.S. patent application Ser. No. 11/717,634 by Chan et al., entitled "Adjacent Plated Through Holes with Staggered Couplings for Crosstalk Reduction in High Speed Printed Circuit Boards," filed Mar. 14, 2007, the entire disclosure of which is incorporated herein by reference. The first circuit board 500 also includes a first circuit board coupling 504. The first circuit board coupling 504 provides electrical, mechanical, or electromechanical coupling between the first circuit board 500 and another electrical component. The first circuit board coupling 504 can be a plated through hole or via. The first circuit board coupling 504 can be electrically connected to a pathway for a signal or to a reference voltage, such as ground. The number of first circuit board couplings 504 illustrated is exemplary only and is not intended to be limiting.

The second circuit board 600 provides another surface 602 for electrical components and their interconnections. The second circuit board 600 includes a second circuit board coupling 604. The second circuit board 600, the surface 602, and the second circuit board coupling 604 are substantially similar to the first circuit board 500, the surface 502 of the first circuit board 500, and the first circuit board coupling 504, respectively.

The first and second connectors 100 and 400 are configured so that the first and second circuit boards 500 and 600 are connected when they are substantially orthogonal to each other, as shown in FIG. 1. The first and second connectors 100 and 400 can also be configured so that the first and second circuit boards 500 and 600 are not substantially orthogonal to each other, such as at an angle with respect to each other or substantially parallel to each other.

The first connector 100 includes a first wafer 200 and a second wafer 300. The first and second wafers 200 and 300 couple to the first circuit board 500 and the second connector 400. The first and second wafers 200 and 300 each provide shielded, conductive pathways between the first circuit board 500 and the second connector 400. In the embodiment shown, the wafers 200 and 300 have a planar structure so that the wafers 200 and 300 can be placed adjacent to each other to form the first connector 100. The planes of the wafers 200 and 300 are parallel to each other. Also, the first and second wafers 200 and 300 are alternately disposed with one another to form a repeating pattern of first and second wafers 200, 300, 200, 300, etc., so that adjacent wafers 200 and 300 can provide shielding to each other's shielded, conductive pathways. Although only two wafers 200 and 300 are shown for clarity, the first connector 100 may have more than two wafers 200 and 300. The optimal number of wafers 200 and 300 depends on the configuration of the first and second circuit boards 500 and 600, for instance, the number of shielded, conductive pathways required between the first and second circuit boards 500 and 600. The first and second wafers 200 and 300 couple to the second connector 400, and the second connector 400 provides shielded, conductive pathways from the wafers 200 and 300 of the first connector 100 to the second circuit board 600.

The first and second wafers 200 and 300 can be supported by a stiffener (not shown), such as the one described in U.S. Pat. No. 5,672,064 to Provencher et al, entitled "Stiffener for Electrical Connector," the entire disclosure of which is incorporated herein by reference. Each wafer 200 and 300 has one or more inserts 102 which are inserted into corresponding apertures in the stiffener to locate each wafer 200 and 300 with respect to one another and to prevent undesired movement or rotation of the wafers 200 and 300.

Referring to FIG. 2, the second connector 400 includes a third shield 410, a fourth shield 420, a third signal conductor 430, and a fourth signal conductor 440. The third and fourth signal conductors 430 and 440 provide conductive pathways between the first connector 100 and the second circuit board 600 through the second connector 400. The third and fourth shields 410 and 420 substantially shield the third and fourth signal conductors 430 and 440.

The third shield 410 couples with a second shield coupling 214 of the first wafer 200 and a fourth shield coupling 314 of the second wafer 300. The third shield 410 also couples with the fourth shield 420. The third shield 410 and the fourth shield 420 couple with each other substantially perpendicularly. In the embodiment shown, a multitude of third shields 410 is provided substantially parallel to one another, and a multitude of fourth shields 420 is provided substantially parallel to one another, thus when the third and fourth shields 410 and 420 are provided substantially perpendicular to each other, the third and fourth shields 410 and 420 surround a pair of third and fourth signal conductors 430 and 440.

At one of their respective ends, the third and fourth signal conductors 430 and 440 couple with a second signal contact 234 of the first wafer 200 and a fourth signal contact 334 of the second wafer 300. Preferably, the third and fourth signal conductors 430 and 440 are provided in pairs to form differential pairs. Thus, the third signal conductor 430 couples with the second signal contact 234 or the fourth signal contact 334, while the fourth signal conductor 440 couples with the remaining fourth or second signal contact 334 or 234. At their respective opposite ends, the third and fourth signal conductors 430 and 440 couple with their respective second circuit board coupling 604 (shown in FIG. 1), thus completing the signal pathway from the first circuit board 500 (shown in FIG. 1) to the second circuit board 600 (shown in FIG. 1).

The second connector 400 also includes a bottom surface 402 and sidewalls 404. Preferably, the second connector 400 has two sidewalls 404 opposite each other and extending substantially the length of two opposing edges of the bottom surface 402. The bottom surface 402 is adapted to receive the fourth shield 420, the third signal conductor 430, and the fourth signal conductor 440. In the embodiment depicted, the bottom surface 402 receives and holds in place the fourth shields 420, the third signal conductors 430, and the fourth signal conductors 440. At least one of the sidewalls 404 of the second connector 400 is adapted to receive the first and second wafers 200 and 300. The sidewalls 404 preferably have grooves 405 adapted to slidably receive, guide, and hold the first and second wafers 200 and 300 in the second connector 400. The grooves 405 run vertically along an inner surface of the sidewalls 404.

In the embodiment shown, the second connector 400 includes an alignment pin 406 and an alignment pin receptacle 408. The alignment pin 406 is received by an end block, as shown and described in U.S. Patent Application Pub. No. 2004/0264153 to Payne et al. Similarly, the guide pin receptacle 408 receives a corresponding guide pin from the end block. In Payne et al., the end blocks have a guide pin which is received by the guide pin receptacle 408 and an alignment pin receptacle that receives the alignment pin 406. The first and second wafers 200 and 300 are also attached to the end blocks by the stiffener and can be connected to the second connector 400 as one single unit.

As shown in FIG. 2, the first wafer 200 has an insulative body 202. The insulative body 202 is made according to the method described in U.S. Pat. No. 6,409,543 entitled "Connector Molding Method and Shielded Waferized Connector Made Therefrom" to Astbury, Jr. et al. or includes lossy material as described in U.S. patent application Ser. No. 10/955,571, entitled "High Speed, High Density Electrical Connector," filed Sep. 30, 2004 by Gailus, publication no. US 2006/0068640, the entire disclosures of which are incorporated herein by reference. The insulative body 202 provides mechanical support to a first shield plate 210 (shown in FIG. 3) and a first signal conductor pair 230 (shown in FIG. 5), both of which are disposed within the insulative body 202. The insulative body 202 also electrically and mechanically insulates the first signal conductor pair 230 from the first shield plate 210 so that the first signal conductor pair 230 is not grounded by the first shield plate 210.

Figure 3:
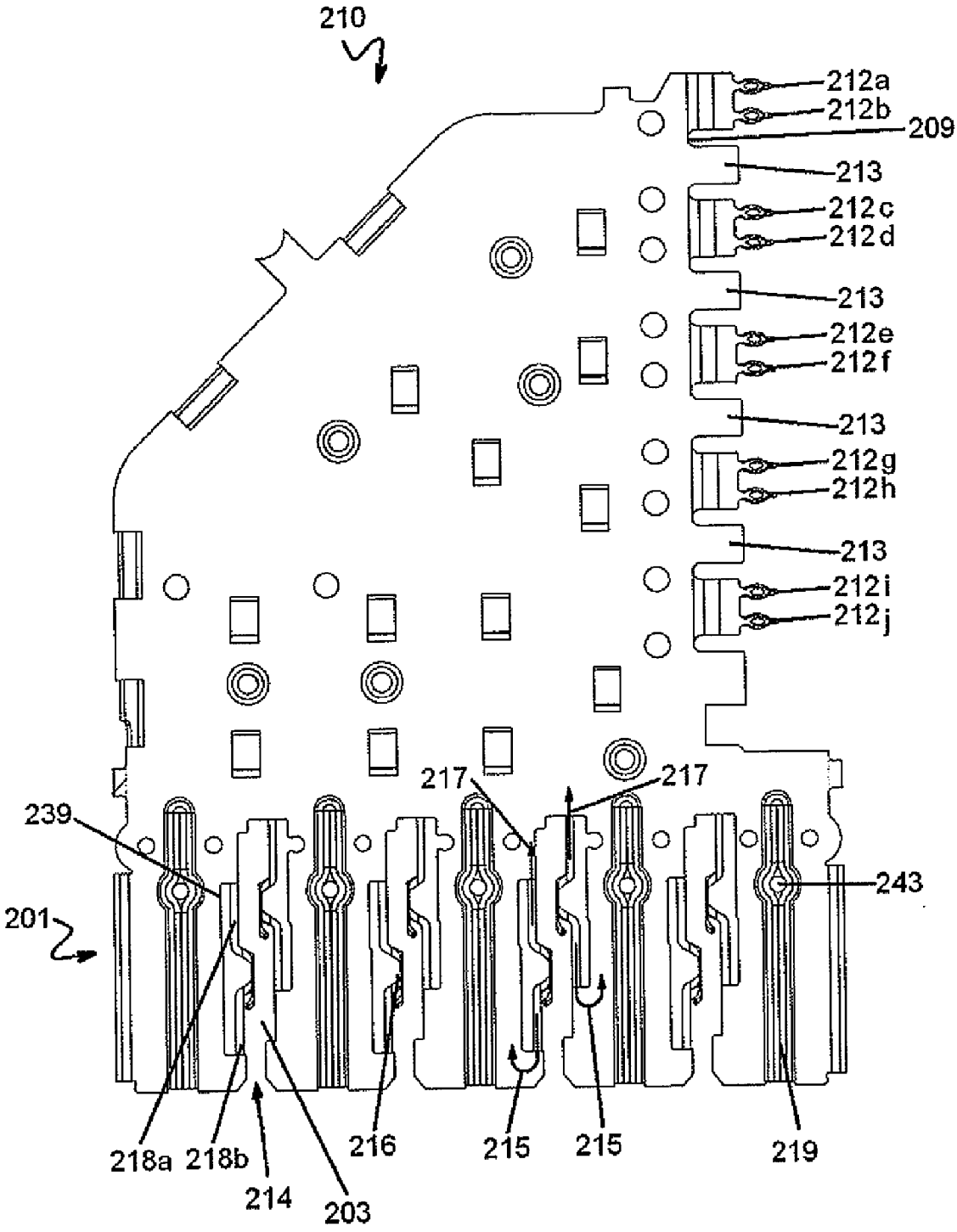
FIG. 3 is a front elevational view of a first shield plate of a first wafer of the first connector illustrated in FIG. 2.

Referring to FIG. 3, the first shield plate 210 is shown without the insulative body 202 and the first signal conductor pair 230. The first shield plate 210 provides shielding to the first signal conductor pair 230 so that crosstalk between the first signal conductor pairs 230 is substantially reduced. Crosstalk is substantially reduced because the first signal conductor pairs 230 are spaced farther apart from each other and nearer to the first shield plate 210 so that the first signal conductor pairs 230 electromagnetically couple to the shield plate 210 instead of each other. The first shield plate 210 shields the first signal conductor pairs 230 for substantially its entire length. The first shield plate 210 preferably has a substantially planar shape and is made of a conductive material.

The first shield plate 210 has a first shield coupling 212 and a second shield coupling 214. In the embodiment shown, the first shield plate 210 has a multitude of first shield couplings 212*a*-212*j* that are disposed along one side edge of the first shield plate 210. The first shield couplings 212*a*-212*j* couple with respective first circuit board couplings 504 that are connected to a reference voltage, such as ground. As shown, the first shield couplings 212*a*-212*j* are disposed in differential pairs and extend out from a leading side edge of the first shield plate 210. The first shield couplings 212*a*-212*j* are preferably press-fit contacts that are received by the first circuit board couplings 504, but can also be any other suitable mechanical, electrical, or electromechanical coupling. The first shield couplings 212*a*-212*j* are also not in the same plane as the first shield extensions 213. The first shield couplings 212*a*-212*j* are bent in a general S-shape so that the first shield couplings 212*a*-212*j* are substantially parallel to and above (in the embodiment of FIG. 3) the plane of the first shield plate 210. This provides the first shield couplings 212*a*-212*j* with structural elasticity and renders them less susceptible to bending out of alignment when the first shield couplings 212*a*-212*j* are pressed into the first circuit board couplings 504.

As shown in FIG. 3, the first shield extensions 213 are placed between the respective pairs of the first shield couplings 212*a*-212*j*. The first shield extensions 213 reduce crosstalk between adjacent signals in neighboring wafers 200, 300. The first shield extensions 213 extend out from a leading side edge of the first shield plate 210. To prevent shearing of the first shield plate 210 between adjacent first shield extensions 213 and first shield couplings 212*a*-212*j*, U-shaped cutouts 209 are formed between the adjacent first shield extensions 213 and the first shield couplings 212*a*-212*j*.

Disposed along the bottom edge of the first shield plate 210 are a multitude of fingers 201 with receiving channels 203 between the fingers 201. Since the connector assembly 10 couples the first circuit board 500 to a second circuit board 600 that is substantially perpendicular to the first circuit board 500, the fingers 201 are on an edge that is substantially perpendicular to the first shield couplings 212*a*-212*j*. The fingers 201 are substantially planar structures that extend from the first shield plate 210 parallel to the plane of the first shield plate 210. The fingers 201 have at least one recess 239 on the side adjacent the receiving channel 203. The recess 239 has at least one second shield coupling 214 that has a shield contact 216 with connection arms 218*a, b* that connect the shield contact 216 to the rest of the finger 201. The second shield coupling 214 also includes current paths 215, 217, a shield contact 216, a deflecting portion 220, a protrusion 222, and a tab 223. The second shield coupling 214 couples the first shield plate 210 with the third shield 410. In the embodiment shown, the second shield coupling 214 has two shield contacts 216 that receive the fifth shield coupling 412 of the third shield 410 (FIG. 19). The connecting arms 218*a* and 218*b* extend from opposite sides of the shield contact 216 and provide mechanical support to the shield contact 216.

A stiffening member 219 is provided on each finger 201. The stiffening member 219 provides structural support to the fingers 201. Because the fingers 201 are cut out of and formed from the first shield plate 210, areas near the fingers 201 require extra structural support to prevent buckling during manufacturing, coupling, and assembly. The stiffening member 219 is made during the stamping process that forms the first shield plate 210 and has a substantially semi-circular cross-section. The stiffening member 219 extends substantially the length of the finger 201. The substantially semi-circular cross-section and length of the stiffening member 219 increases the rigidity and deflection resistance of the finger 201. A hole 243 may be stamped into the stiffening member 219 to provide an anchor for the insulative body 202.

Referring to FIG. 4, the second shield coupling 214 and the second contact 234 within the insulative body 202 of the first wafer 200 are shown in greater detail. The shield contact 216 has two connecting arm members 218*a, b*, which connect to the first shield plate 210. The connecting arm members 218*a, b* each provide a current path between the shield contact 216 and the first shield plate 210. In the embodiment depicted, current flows along two paths 215, 217 from the shield contact 216, through each of the connecting arm members 218*a, b* and into the finger 201 of the first shield plate 210. The current paths 215, 217 improve the effectiveness of the first shield plate 210 and enhance crosstalk reduction. The current paths 215, 217 substantially utilize the entire shield plate fingers 201, thus improving the effectiveness of the fingers 201. The connecting arm members 218*a, b* extend out of portions of each finger 201, and the shield contact 216 is separated from the finger 201 by an opening 241 so that the current paths 215, 217 force current to outer extremities of the finger 201 to increase the use of the entire finger 201. Also, the current paths 215, 217 increase flexibility of connecting arm members 218*a, b* to form solid contact with the third shield 410. A tab 223 can be provided during the manufacturing process for mold shut-off when the insulative body 202 is placed over the first shield plate 210. The tab 223 can also be formed as part of the die casting of the first shield plate 210.

In the embodiment shown, the shield contact 216 has a deflecting portion 220. The deflecting portion 220 prevents stubbing when the third shield coupling 412 slidably enters the receiving channel 203 to engage the shield contact 216 of the second shield coupling 214. The leading end of the shield contact 216 is turned back toward the connecting arm member 218*a* or 218*b* to form the deflecting portion 220. The deflecting portion 220 is disposed on the shield contact 216 where it first engages the third shield 410. In one embodiment, the shield contact 216 is formed by stamping. After stamping, the first shield plate 210 is shaped, folded, deformed, or otherwise manipulated to form the shield contacts 216. In particular, metal in the region of the first shield plate 210 where the shield contacts 216 are formed is stamped and then the stamped shape is folded twice to form the shield contacts 216. In the embodiment shown, the shield contacts 216 are folded once substantially perpendicular to the plane of the first shield plate 210 (out of the page in the embodiment of FIG. 3) so that the shield contact 216 can slidably receive the third shield coupling 412. Then, a portion of the shield contact 216 is folded away from the receiving channel 203 to form the deflecting portion 220.

The shield contact 216 also has a protrusion 222 that provides a point of contact between the first shield plate 210 and the third shield 410. The protrusion 222 has a substantially hemispherical shape to provide a better connection point between the first shield plate 210 and the third shield 410. When the shield contact 216 engages the third shield 410, the protrusion 222 causes the shield contact 216 to elastically flex away from the third shield 410. The shield contact 216 is thus biased toward the third shield 410 by the connecting arm members 218*a* and 218*b* to maintain contact between the shield contact 216 and the third shield 410. The protrusion 222 concentrates forces so that higher contact pressure between the shield contact 216 and the third shield 410 ensures a good connection. The shape of the protrusion 222 cuts through the dust, oil, debris, and other obstructions that can prevent an electrical connection between the shield contact 216 and the third shield 410. In one embodiment, the protrusion 222 formed by stamping. The shield contacts 216, the connecting arm members 218*a* and 218*b*, the deflecting portion 220, and the protrusion 222 are preferably made of the same material as the first shield plate 210.

The insulative body 202 has a cap portion 205 formed over the shield plate fingers 201. The cap portion 205 protects the second contacts 234. The cap portion 205 has angled surfaces 221 and separate passageways 237. Angled surfaces 221 are provided at the entrance of the second shield coupling 214, and the angled surfaces 221 guide the third shield 410 to enter the channel 203 between the shield contacts 216. The angled surfaces 221 prevent stubbing of the third shield 410 as it is received by the second shield coupling 214.

The separate passageways 237 have inclined surfaces 235 near the second contacts 234. The inclined surfaces 235 prevent stubbing of the third and fourth signal conductors 430 and 440 as they couple with the second contacts 234. The inclined surfaces 235 are inclined inwardly so that the third and fourth signal conductors 430 and 440 are aligned with the second contacts 234 and mate properly.

Referring to FIG. 5, each of the first signal conductor pairs 230 have a first contact 232*a*-232*j* and a second contact 234 at an opposite end with an intermediate portion 233 therebetween. In the embodiment depicted, the first signal conductor pairs 230 are provided in pairs to form a pathway for differential signals, with the positive polarity signal on one member of the pair and the negative polarity signal on the other member of the pair. Accordingly, the intermediate portions 233 of the pair are disposed in close proximity to each other in parallel and are spaced apart from neighboring pairs. The first signal conductor pairs 230 are made of a conductive material. The number of first signal conductor pairs 230 is exemplary only and not meant to be limiting. The optimal number of first signal conductor pairs 230 may be more or less than the number shown. The exact number of first signal conductor pairs 230 depends on the number of desired conductive pathways between the first circuit board 500 and the second circuit board 600.

Each first contact 232*a*-232*j* couples with one of the first circuit board couplings 504. Preferably, the first contact 232*a*-232*j* is a press-fit "eye of the needle" compliant contact that is pressed into a plated through hole or another structure disposed as the first circuit board coupling 504 on the first circuit board 500. However, other configurations for the first contact 232*a*-232*j* are suitable, such as surface mount elements, spring contacts, solderable pins, and other similar mechanical, electrical, or electromechanical couplings. Furthermore, the first signal conductor pairs 230 are formed so as to be disposed between adjacent first shield couplings 212*a*-212*j* and adjacent second shield couplings 214*a*-214*j*. The second contact 234 can be a dual beam contact, as shown, or any other electrical, mechanical, or electromechanical coupling.

Referring to FIG. 6, the first signal conductor pairs 230 are shown positioned on the first shield plate 210 before the insulative body 202 is formed. In an actual embodiment, the insulative body 202 is disposed between the first signal conductor pairs 230 and the first shield plate 210. The first signal conductor pairs 230 are paired differential signal conductors, thus for instance, conductors 232*a* and 232*b* form a first differential pair, conductors 232*c* and 232*d* form a second differential pair, etc. Pairs of first contacts 232*a*-232*j* are disposed between pairs of first shield couplings 212*a*-212*j* and above the first shield extensions 213. For example, first contacts 232*a*-232*b* are between first shield couplings 212*a*-212*b* and 212*c*-212*d*. By placing the first contacts 232*a*-232*j* between first shield couplings 212*a*-212*j*, the first signal conductor pairs 230 are spaced further apart from each other and closer to a portion of the first shield plate 210, thus reducing crosstalk.

Also, the first shield couplings 212*a*-212*j* have a bend so as to be offset from the plane of the first shield plate 210 and aligned with the first contacts 232*a*-232*j* of the first signal conductor pairs 230. Thus, the couplings 212*a*-212*j* and the contacts 232*a*-232*j* form a single linear column along the edge of the first wafer 200, as best shown in FIG. 11. Furthermore, by bending the first shield couplings 212*a*-212*j* above the plane of the first shield plate 210, in the embodiment of FIG. 6, the first shield couplings 212*a*-212*j* obtain structural elasticity and are less susceptible to damage when the first shield couplings 212*a*-212*j* are pressed into the first circuit board couplings 504, thereby making the first wafer 200 more robust. The first wafer 200 is able to couple to the first circuit board 500 through coupling of the first shield couplings 212*a*-212*j* and the first contacts 232*a*-232*j* with respective first circuit board couplings 504.

As shown in FIG. 2, the second wafer 300 has an insulative body 302. Disposed substantially within the insulative body 302 are a second shield plate 310 (shown in FIG. 7) and a second signal conductor pair 330 (shown in FIG. 9). The insulative body 302 is substantially similar to the insulative body 202 of the first wafer.

Figure 7:
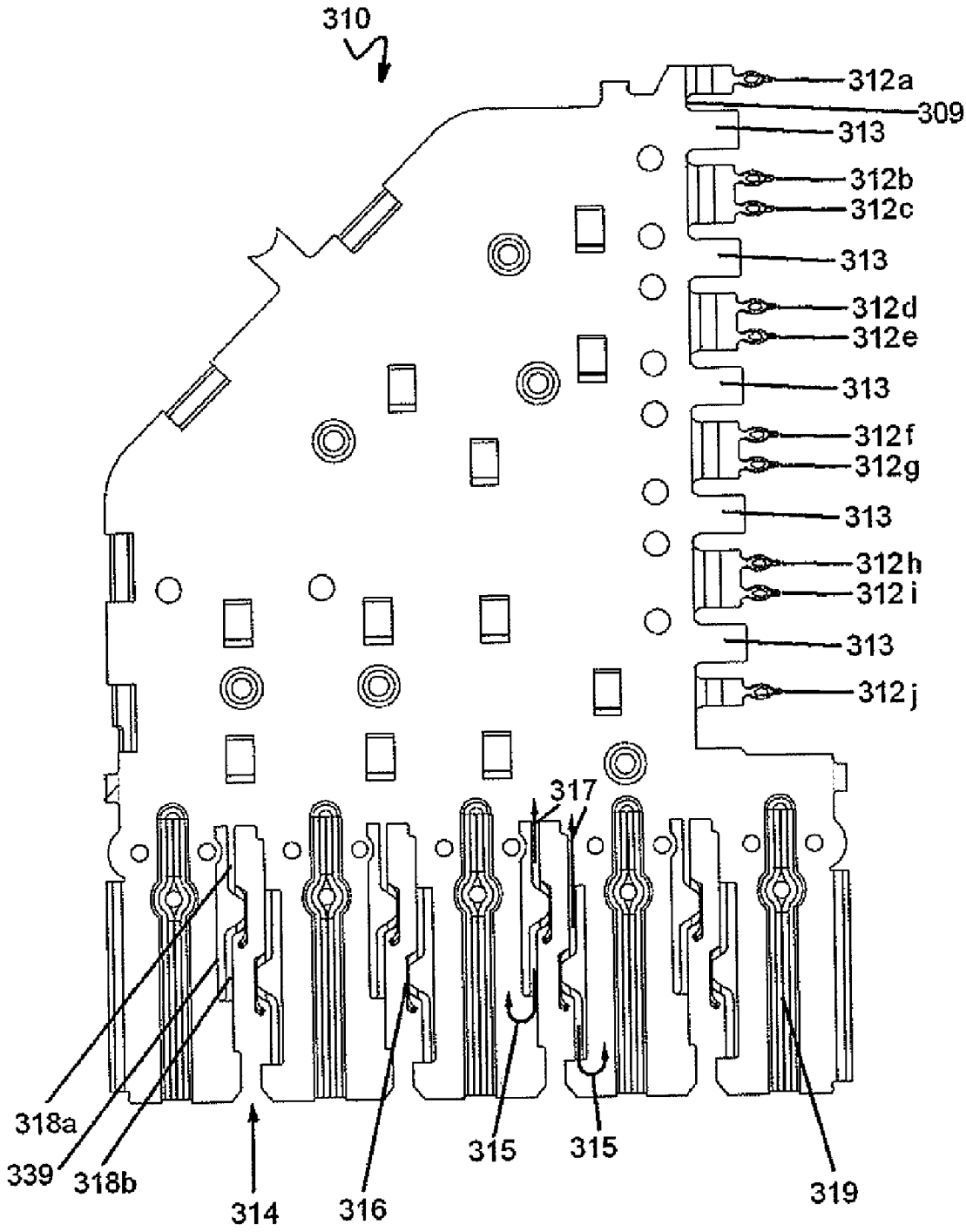
FIG. 7 is a front elevational view of a second shield plate of a second wafer of the first connector illustrated in FIG. 2.

Referring to FIG. 7, the second shield plate 310 shields the second signal conductor pair 330 for substantially its entire length. The second shield plate 310 has a third shield coupling 312*a*-312*j* and a fourth shield coupling 314. The second shield plate 310, the third shield coupling 312*a*-312*j*, and the fourth shield coupling 314 are substantially similar to the first shield plate 210, the first shield coupling 212*a*-212*j*, and the second shield coupling 214, respectively. The second shield plate 310 also has second shield extensions 313 and U-shaped cutout 309 which are substantially similar to the first shield extensions 213 and U-shaped cutouts 209 of the first shield plate 210. The second shield plate 310 can also have a stiffening member 319 which is substantially similar to the stiffening member 219 of the first shield plate 210.

Unlike the first shield plate 210 where the first shield couplings 212*a*-212*j* are disposed in pairs along one edge, the second shield plate 310 has at least one unpaired third shield coupling 312*a* and 312*j*. The unpaired third shield couplings 312*a* and 312*j* are provided to ensure that the first shield couplings 212*a*-212*j* are not aligned with the third shield couplings 312*a*-312*j* when wafers 200 and 300 are placed adjacent to each other. Thus, the first shield couplings 212*a*-212*j* and third shield couplings 312*a*-312*j* provide signal shielding to adjacent third and first contacts 332*a*-332*j* and 232*a*-232*j*. In the embodiment depicted in FIG. 7, there are two unpaired third shield couplings 312*a* and 312*j*, and the remaining third shield couplings 312*b*-312*i* are provided in pairs.

The fourth shield coupling 314 includes at least one or more shield contacts 316. The shield contacts 316 are substantially similar to the shield contacts 216 of the first wafer 200. The shield contacts 316 also provide more than one current path 315 and 317. Referring to FIG. 8, the fourth shield coupling 314 and the fourth contact 334 are shown in greater detail. The second shield plate 310 has fourth shield couplings 314 with two shield contacts 316 similar to the second shield couplings 214 of the first shield plate 210. But, the shield contacts 316 of the second wafer 300 are disposed such that the shield contacts 216, 316 on adjacent wafers 200, 300 do not overlap when the wafers 200 and 300 are aligned side-by-side in the second connector 400. Thus, for example, the shield contacts 216 on the first wafer 200 are positioned on the lower left and upper right of the second shield coupling 214 (see FIGS. 3 and 4), whereas the counterpart shield contacts 316 on the second wafer 300 are positioned on the upper left and lower right of the fourth shield coupling 314 (see FIGS. 7 and 8). Accordingly, when the first wafer 200 and the second wafer 300 are placed adjacent to each other such that the second shield coupling 214 overlaps the fourth shield coupling 314, the third shield 410 engages the two shield contacts 216 and 316 on the left and two shield contacts 216 and 316 on the right. The terms "left," "right," "upper," and "lower" are used to illustrate and describe the invention in relation to the figures only and are not meant to be limiting to the invention. In alternate embodiments, the shield contacts 216 and 316 may be disposed in locations opposite to what has been described. Also, the number of shield contacts 216 and 316 may vary, thus the two shield contacts 216 shown for the second shield coupling 214 or the two shield contacts 316 shown for the fourth shield coupling 314 are not meant to be limiting.

The insulative body 302 has a cap portion 305 formed over the shield plate fingers 301. The cap portion 305 is substantially similar to the cap portion 205 of the first wafer 200. The cap portion 305 protects the fourth contacts 334. The cap portion 305 has angled surfaces 321 and separate passageways 337 substantially similar to angled surfaces 221 and separate passageways 237 of the cap portion 205 of the first wafer 200. Angled surfaces 321 are provided at the entrance of the second shield coupling 314, and the angled surfaces 321 guide the third shield 410 to enter the channel 303 between the shield contacts 316. The angled surfaces 321 prevent stubbing of the third shield 410 as it is received by the fourth shield coupling 314.

Referring to FIG. 9, the second signal conductor pairs 330 provide the conductive pathways from the first circuit board 500 to the second connector 400. The second signal conductor pairs 330 have a third contact 332*a*-332*j* and a fourth contact 334 with an intermediate portion 333 between the contacts 332*a*-332*j* and 334. The second signal conductor pair 330, the third contact 332*a*-332*j*, the intermediate portion 333, and the fourth contact 334 are substantially similar to the first signal conductor pair 230, the first contact 232*a*-232*j*, the intermediate portion 233, and the second contact 234, respectively.

Referring to FIG. 10, the second signal conductor pairs 330 are shown disposed adjacent to the second shield plate 310 without the insulative body 302 of the second wafer 300. The second shield plate 310 shields the second signal conductor pairs 330 for substantially their entire length. Pairs of third contacts 332*a*-332*j* are disposed between pairs of third shield couplings 312*a*-312*j*. Unlike the first shield plate 210 and first signal conductor pairs 230 shown in FIG. 6, there are unpaired third shield couplings 312*a* and 312*j* disposed at the outermost positions of the column of third contacts 332*a*-332*j* and third shield couplings 312*a*-312*j*.

Referring to FIG. 11, the first wafer 200 and the second wafer 300 are shown aligned with respect to each other. In the embodiment shown, the first shield couplings 212*a*-212*j* of the first shield plate 210 and the first contacts 232*a*-232*j* of the first signal conductor pairs 230 are arranged in a column along an outer edge of the first wafer 200. The first shield couplings 212*a*-212*j* and the first contacts 232*a*-232*j* are provided in pairs that alternate with each other so that the first contacts 232*a*-232*j* are shielded by adjacent first shield couplings 212*a*-212*j* within the same column. Shielding to prevent crosstalk between adjacent signal conductors 230 is provided by placing the first signal conductors 230 farther apart from each other and nearer to the first shield couplings 212*a*-212*j*. Similar to the first wafer 200, the third shield couplings 312*a*-312*j* and the third contacts 332*a*-332*j* are preferably arranged in a column along an edge of the second wafer 300. Also, the third shield couplings 312*a*-312*j* and the third contacts 332*a*-332*j* are provided in pairs that alternate with each other so that the third contacts 332*a*-332*j* are shielded by adjacent third shield couplings 312*a*-312*j* within the same column.

In addition, the first shield coupling 212*a*-212*j* of the first wafer 200 and the third shield coupling 312*a*-312*j* of the second wafer 300 are disposed adjacent to the first and third contacts 232*a*-232*j* or 332*a*-332*j* of the adjacent wafer 200 or 300. The first and third shield couplings 212*a*-212*j* and 312*a*-312*j* shield a third or first contact 332*a*-332*j* or 232*a*-232*j* in an adjacent wafer 300 or 200. The first shield couplings 212*a*-212*j* of the first wafer 200 are disposed such that they are adjacent to at least one of the third contacts 332*a*-332*j* of the second wafer 300. For example, the first shield coupling 212*b* and 212*d* are adjacent to and shield the third contact 332*a* and 332*c*, respectively. Similarly, for instance, the third shield coupling 312*b* and 312*d* of the second wafer 300 are adjacent to and shield the first contacts 232*b* and 232*d* of the first wafer 200, respectively. Therefore, the first and third contacts 232*a*-232*j* and 332*a*-332*j* are shielded by the shield couplings 312*a*-312*j* and 212*a*-212*j* in adjacent wafers and also by the shield couplings 212*a*-212*j* and 312*a*-312*j* in their own respective wafer 200 or 300. Thus, for example, the first contacts 232*a*-232*j* are shielded by adjacent first shield couplings 212*a*-212*j* within its column and by third shield couplings 312*a*-312*j* in an adjacent column. Similarly, third contacts 332*a*-332*j* are shielded by adjacent third shield couplings 312*a*-312*j* within its column and shielded by first shield couplings 212*a*-212*j* in an adjacent column.

Figure 12:
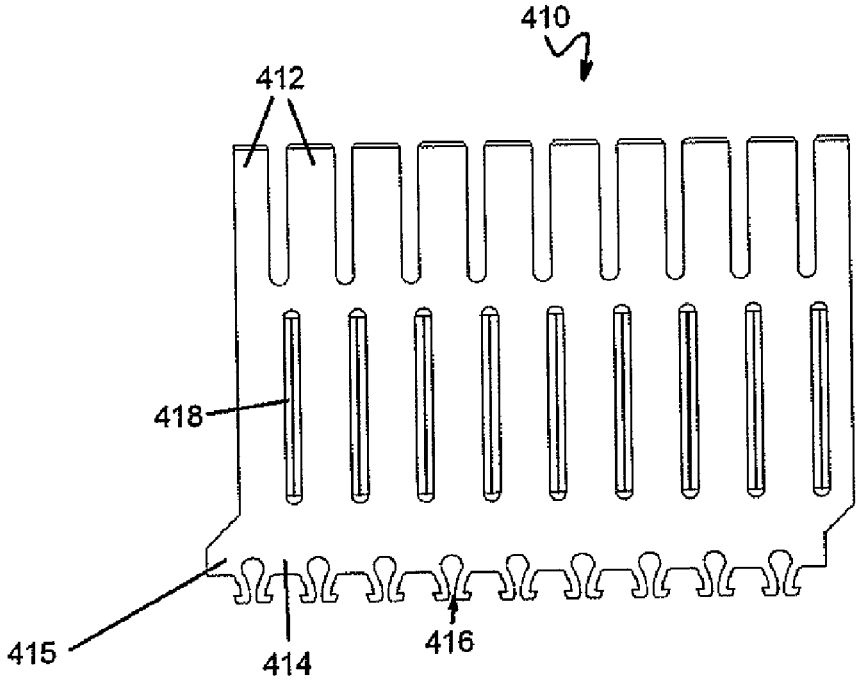
FIG. 12 is a side elevational view of a third shield of the second connector illustrated in FIG. 2.

Referring to FIG. 12, the third shield plate 410 of the second connector 400 from FIG. 2 is shown in greater detail. The third shield 410 provides shielding and thus is made from electrically conductive material. The third shield 410 has fifth shield couplings 412. In the embodiment depicted, the fifth shield coupling 412 has an elongated, planar shape that engages the second and fourth shield couplings 214 and 314 of the first and second wafers 200 and 300. The third shield plate 410 also has sixth shield couplings 414 opposite the fifth shield coupling 412. The sixth shield couplings 414 preferably has an elongated, planar shape that couples with the fourth shield 420.

The third shield 410 can also have a mating clasp 416 and/or a strengthening rib 418. The mating clasp 416 couples the third shield 410 to the second connector 400. In the embodiment depicted, the mating clasp 416 are placed between adjacent sixth shield couplings 414 and couples with the bottom surface 402 of the second connector 400, such as through an opening 417 that is smaller in width then the mating clasp 416, as shown in FIG. 24. The strengthening rib 418 provides structural support to the third shield 410 and prevents buckling of the third shield 410 during manufacturing, coupling, and assembly. In the embodiment shown in FIG. 12, the strengthening rib 418 is formed by stamping and made from the same material as the third shield 410. The strengthening ribs 418 are formed or placed to extend between fifth and sixth shield couplings 412 and 414. The number of strengthening ribs 418 is exemplary only and may be more or less in an actual embodiment so that adequate mechanical support is provided to the third shield 410 by the strengthening ribs 418. An extension 415 can be formed to provide mechanical support for a mating clasp 416 that is at the extreme end of an edge of the third shield 410 and thus might otherwise not be supported by the third shield 410.

Referring to FIG. 13, the fourth shield 420 of the second connector 400 is shown. The fourth shield 420 provides shielding and thus is made from electrically conductive material. In the embodiment depicted, the fourth shield 420 has a generally elongated, planar shape with seventh shield couplings 422 along one edge and eighth shield couplings 424 along an opposite edge. The seventh shield couplings 422 receive and mate with the sixth shield couplings 414 of the third shield plate 410. In the embodiment depicted, the seventh shield coupling 422 is a press-fit connection, and the eighth shield coupling 424 is a press-fit "eye of the needle" compliant contact. In particular, the seventh shield coupling 422 is stamped to form opposing compliant arcs 423 with a slot between the arcs 423 to receive the sixth shield coupling 414. The fourth shield 420 also has extensions 426 placed at opposite longitudinal ends of the fourth shield 420. The extensions 426 provide better retention of the fourth shield 420 to the second connector 400. In one embodiment, the extensions 426 are received by the molded plastic forming the sidewalls 404 of the second connector 400. Also, comparing the third shield plate 410 of FIG. 12 to the fourth shield 420 of the FIG. 13, the fourth shield 420 is shorter in height than the third shield plate 410. The fourth shield 420 is shorter so that, when the electrical connector assembly 10 is assembled, the wafers 200 and 300 can be placed immediately adjacent to each other with their respective insulative housings 202 and 302 resting above the fourth shield plates 420.

Referring to FIG. 14, the third shield 410 (FIG. 12) and the fourth shield 420 (FIG. 13) are shown coupled to each other in a substantially perpendicular configuration to form a rectangular shape having multiple rows and columns forming multiple substantially rectangular boxes, as shown in FIG. 23. The sixth shield coupling 412 of the third shield 410 couples with the seventh shield coupling 422 of the fourth shield 420. By providing the third and fourth shields 412 and 422 perpendicular to each other, they shield the third and fourth signal conductors 430 and 440.

Figure 15:
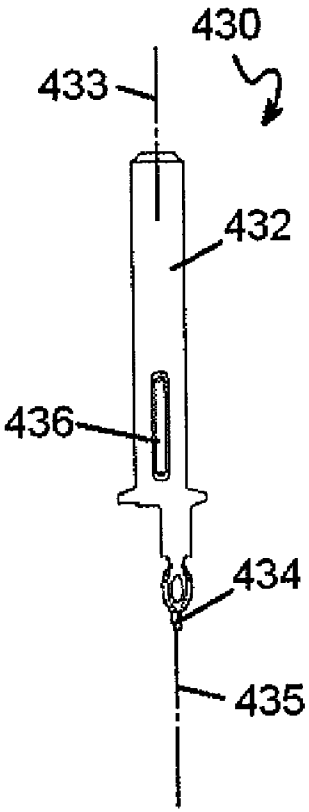
FIG. 15 is a front elevational view of a third signal conductor of the second connector illustrated in FIG. 2.

Referring to FIG. 15, the third signal conductor 430 of the second connector 400 is shown. The third signal conductor 430 has a fifth contact 432 and a sixth contact 434. The fifth contact 432 of the third signal conductor 430 couples with the second and fourth contacts 234 and 334 of the first and second signal conductor pairs 230 and 330. The fifth contact 432 of the third signal conductor 430 preferably has an elongated, planar shape that engages the second and fourth contacts 234 and 334. The sixth contact 434 of the third signal conductor 430 couples with the second circuit board coupling 604. In the embodiment depicted, the sixth contact 434 is a press-fit "eye of the needle" compliant contact that couples with one of the second circuit board couplings 604. Thus, the third signal conductor 430 completes a conductive pathway between the first and second circuit boards 500 and 600.

Figure 16:
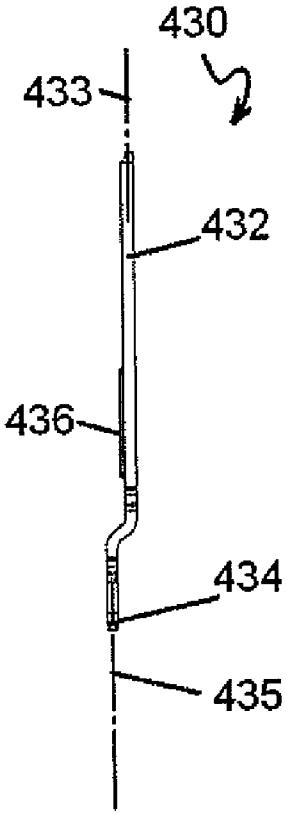
FIG. 16 is a side elevational view of the third signal conductor illustrated in FIG. 14.

Also, the center axis 433 of the fifth contact 432 is not aligned with the center axis 435 of the sixth contact 434. Rather, the sixth contact 434 is offset to one side of the center axis 433 of the fifth contact 432. Referring to FIG. 16, the center axis 435 of the sixth contact 434 of the third signal conductor 430 is also above or in front of the center axis 433 of the fifth contact 432. The center axes 433 and 435 are not aligned so that the sixth contact 434 and eighth contact 444 of the fourth signal conductor 440 can be placed closer to each other than the signal contacts 434 and 444 would be if the axes 433 and 435 were aligned (as shown in FIG. 23). Also, the signal contacts 434 and 444 can placed at an angle with respect to the third shield 410 or the fourth shield 420. When the signal contacts 434 and 444 are placed at an angle with respect to the third shield 410 or fourth shield 420, electrical connector assemblies 10 on opposite sides of second circuit board 600 can be oriented substantially perpendicular to each other.

The third signal conductor 430 can also have a supporting member 436. The supporting member 436 provides structural support to the third signal conductor 430 to prevent buckling during manufacturing, coupling, or assembly.

Figure 17:
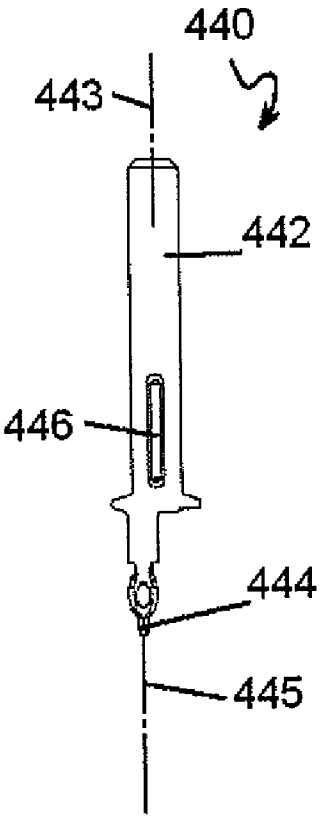
FIG. 17 is a front elevational view of a fourth signal conductor of the second connector illustrated in FIG. 2.

Referring to FIG. 17, the fourth signal conductor 440 of the second connector 400 is shown. The fourth signal conductor 440 has a seventh contact 442 and an eighth contact 444. The seventh and eighth contacts 442 and 444 are substantially similar to the fifth and sixth contacts 432 and 434 of the third signal conductor 430. However, the center axis 445 of the eighth contact 444 is aligned on the opposite side of the center axis 443 of the seventh contact 442 when compared to the center axes 435 and 433 of the third signal conductor 430. The fourth signal conductor 440 can also have a supporting member 446 which is substantially similar to supporting member 436 of the third signal conductor 430. As discussed above, the offset in the center axes 443 and 445 allows the sixth and eighth contacts 434 and 444 to be placed closer to each other. Also, the offset allows the sixth and eighth contacts 434 and 444 to be placed at an angle with respect to the third shield 410 or the fourth shield 420, as shown in FIG. 23.

Figure 18:
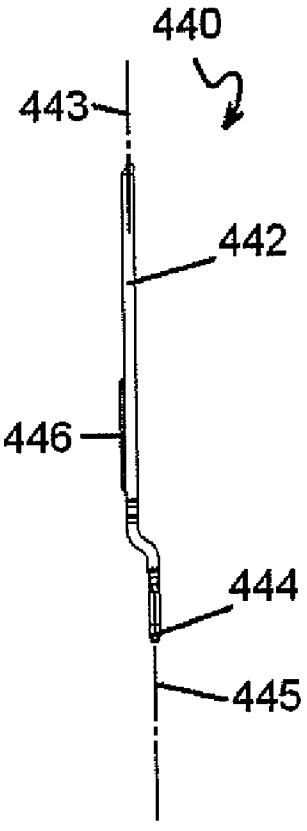
FIG. 18 is a side elevational view of the fourth signal conductor illustrated in FIG. 16.

Referring to FIG. 18, the center axis 445 of the eighth contact 444 relative to the center axis 443 of the seventh contact 442 is also opposite that of the relation between the center axis 435 of the sixth contact 434 and the center axis 433 of the fifth contact 432. Thus, when comparing FIGS. 15 and 17, the sixth and eighth contacts 434 and 444 are aligned to opposite sides of their respective fifth and seventh contacts 432 and 442. In particular, in the depictions shown, the sixth contact 434 is to the right of the fifth contact 432, and the eighth contact 444 is to the left of the seventh contact 442. Also, when comparing FIGS. 16 and 18, the sixth and eighth contacts 434 and 444 are above and below their respective fifth and seventh contacts 432 and 442. In the embodiment shown, the sixth contact 434 is above or in front of the fifth contact 432, whereas the eighth contact 444 is below or behind the seventh contact 442.

Referring to FIGS. 19-21, the third and fourth shields 410 and 420 shield the third and fourth signal conductors 430 and 440. As shown in FIG. 19, the third shield 410 is disposed on opposing sides of the third and fourth signal conductors 430 and 440. In addition, fourth shields 420 are disposed substantially perpendicular to the third shields 410 to provide shielding on the front and back sides of the third and fourth signal conductors 430 and 440. Thus, the third and fourth shields 410 and 420 provide shielding on all sides of each pair of third and fourth signal conductors 430 and 440.

As shown in FIG. 20, the first signal conductor pairs 230 of the first wafer 200 couple with the third and fourth signal conductors 430 and 440 of the second connector 400. In particular, the second contacts 234 of the first signal conductor pairs 230 couple with the fifth and seventh coupling ends 432 and 442 of the third and fourth signal conductors 430 and 440, respectively. As described above, the first shield plate 210 substantially shields the first signal conductor pairs 230, and the third and fourth shields 410 and 420 of the second connector 400 shield the third and fourth signal conductors 430 and 440. Thus, the first wafer 200 and second connector 400 provide shielded conductive pathways between the first circuit board 500 and the second circuit board 600, wherein the first signal conductor pairs 230, the third signal conductors 430, and fourth signal conductors 440 provide the conductive pathways, and the first, third, and fourth shields 210, 410, and 420 provide shielding to the signal conductors 230, 430, and 440. In particular, the first shields 210 provide shielding to opposing sides of the first signal conductor pairs 230, and the third and fourth shields 410 and 420 provide shielding that surrounds the third and fourth signal conductors 430 and 440. Additional shielding for the first signal conductor pairs 230 can be provided by second shields 310, if adjacent wafers 300 are provided.

As shown in FIG. 21, the second signal conductor pairs 330 of the second wafer 300 couple with the third and fourth signal conductors 430 and 440 of the second connector 400. In particular, the fourth coupling end 334 of the second signal conductor pairs 330 couple with the fifth and seventh coupling ends 432 and 442 of the third and fourth signal conductors 430 and 440. Also, the second shield plate 310 substantially shields the second signal conductor pairs 330, and the third and fourth shields 410 and 420 shield the third and fourth signal conductors 430 and 440. Thus, the second wafer 300 provides another set of shielded, conductive pathways between the first circuit board 500 and the second circuit board 600. The second signal conductor pairs 330, the third signal conductors 430, and fourth signal conductors 440 provide the conductive pathways, and the second, third, and fourth shields 310, 410, and 420 provide shielding to the signal conductors 330, 430, and 440.

Referring to FIG. 22, the first and second shield plates 210 and 310 are shown without their respective insulative housings 202 and 302. As shown, the first signal conductor pairs 230 are disposed adjacent to the first shield plate 210, but the conductors 230 do not contact the first shield plate 210. The insulative housing 202 maintains the relative positions of the first signal conductor pairs 230 and the first shield plate 210. Similarly, the insulative housing 302 of the second wafer 300 maintains the second signal conductor pairs 330 adjacent but not touching the second shield plate 310. Thus, signals transmitted through the first and second signal conductors 230 and 330 are not affected by the reference voltage present on the first and second shields 210 and 310. Also, one or more of the wafers 200 or 300 can have a flap 240 that is substantially perpendicular to the plane of the wafer 200 or 300. The flap 240 also helps to reduce crosstalk between conductors 232 and 332 of adjacent wafers 200 and 300.

FIG. 23 shows a footprint of the arrangement of third and fourth shields 410 and 420 and third and fourth signal conductors 430 and 440. The third and fourth shields 410 and 420 provide shielding on all sides of each pair of third and fourth signal conductors 430 and 440. However, the third and fourth shields 410 and 420 do not touch the third and fourth signal conductors 430 and 440. Therefore, the reference voltage of the third and fourth shields 410 and 420 does not affect the signal transmitted on the third and fourth signal conductors 430 and 440.

Referring to FIG. 24, the bottom surface 402 of the second connector 400 is shown. The arrangement shown in FIG. 23 is maintained by the bottom surface 402 of the second connector 400. The eighth shield coupling 424 of the fourth shield 420 are aligned along a line. Between lines of eighth shield couplings 424 are the sixth and eighth contacts 434 and 444 of the third and fourth signal conductors 430 and 440, respectively. Also shown are the mating clasps 416 of the third shield 410. The mating clasps 416 couple the fourth shield 410 to the bottom surface 402 of the second connector 400.

As apparent from the above description, the invention provides an electrical connector assembly 10. The electrical connector assembly 10 maximizes the effectiveness of the shields 210 and 310 by providing more paths for shield currents thereby improving the effectiveness of the shields 210 and 310. The shield currents provide more electromagnetic coupling to the shield 210 and 310 thus reducing crosstalk between adjacent signal conductor pairs 230 and 330. The improved effectiveness of the shield 210 and 310 provides better shielding and improves crosstalk reduction.

While a particular embodiment has been chosen to illustrate the invention, it will be understood by those skilled in the art that various changes and modifications can be made therein without departing from the scope of the invention as defined in the appended claims.

What is claimed is:

1. An electrical connector, the electrical connector comprising:

a shield plate;

a first finger extending from an edge of the shield plate;

a second finger adjacent to the first finger and extending from the edge of the shield plate, thereby forming a channel between the first finger and the second finger; and a coupling disposed within the channel adjacent the first finger, the coupling including, a contact, a first flexible connecting arm extending from a first end of the contact to a first portion of the first finger, and a second flexible connecting arm extending from a second end of the contact to a second portion of the first finger, wherein the contact is separated from the first finger by an opening, wherein the first flexible connecting arm and the second flexible connecting arm are configured to allow the contact to elastically flex both toward and away from the first finger, and wherein the first flexible connecting arm and the second flexible connecting arm provide at least two current paths from the contact to the first finger.

2. An electrical connector according to claim 1, wherein the contact further comprises a deflecting portion extending from the contact and turned toward the first flexible connecting arm.

3. An electrical connector according to claim 1, wherein the contact further comprises a protrusion disposed on the contact.

4. An electrical connector according to claim 1, wherein the coupling further comprises:

a second contact;

a third flexible connecting arm extending from a first end of the second contact to a first portion of the second finger; and a fourth flexible connecting arm extending from a second end of the second contact to a second portion of the second finger, wherein the second contact is separated from the second finger by an opening, wherein the third flexible connecting arm and the fourth flexible connecting arm are configured to allow the second contact to elastically flex both toward and away from the second finger, and wherein the third flexible connecting arm and the fourth flexible connecting arm provide at least two current paths from the second contact to the second finger.

5. An electrical connector according to claim 1, further comprising a signal conductor disposed adjacent the shield plate and the first finger.

6. An electrical connector, the electrical connector comprising:

a first wafer, the first wafer including, a first shield plate, a plurality of first shield couplings disposed in pairs along an edge of the first shield plate to form a first column of first shield couplings, and a plurality of first signal conductors disposed adjacent the first shield plate between respective pairs of first shield couplings; and a second wafer disposed adjacent the first wafer, the second wafer including, a second shield plate, a plurality of second shield couplings disposed along an edge of the second shield plate to form a second column of second shield couplings parallel to the first column of first shield couplings, and a plurality of second signal conductors disposed in pairs adjacent the second shield plate, wherein the first wafer and the second wafer are unique with respect to their arrangements of signal conductors and shield couplings, wherein at least one of the pair of first shield couplings is adjacent to one of the plurality of first signal conductors and at least one of the plurality of second signal conductors, and wherein at least one of the plurality of second shield couplings is adjacent to one of the plurality of second signal conductors and at least one of the plurality of first signal conductors wherein the first shield plate further comprises:

a first finger extending from an edge of the first shield plate;

a second finger adjacent to the first finger and extending from the edge of the first shield plate, thereby forming a channel between the first finger and the second finger; and a coupling disposed within the channel adjacent the first finger, the coupling including, a contact, a first flexible connecting arm extending from a first end of the contact to a first portion of the first finger, and a second flexible connecting arm extending from a second end of the contact to a second portion of the first finger or to the edge of the first shield plate in the channel, wherein the contact is separated from the first finger by an opening, wherein the first flexible connecting arm and the second flexible connecting arm are configured to allow the contact to elastically flex both toward and away from the first finger, and wherein the first flexible connecting arm and the second flexible connecting arm provide at least two current paths from the contact to the first finger or to the first shield plate.

7. An electrical connector according to claim 6, wherein the contact further comprises a deflecting portion extending from the contact and turned toward the first flexible connecting arm.

8. An electrical connector according to claim 6, wherein the contact further comprises a protrusion disposed on the contact.

9. An electrical connector according to claim 6, wherein the coupling further comprises;

a second contact;

a third flexible connecting arm extending from a first end of the second contact to a first portion of the second finger; and a fourth flexible connecting arm extending from a second end of the second contact to a second portion of the second finger, wherein the second contact is separated from the second finger by an opening, wherein the third flexible connecting arm and the fourth flexible connecting arm are configured to allow the second contact to elastically flex both toward and away from the second finger, and wherein the third flexible connecting arm and the fourth flexible connecting arm provide at least two current paths from the second contact to the second finger.

10. An electrical connector according to claim 6, wherein the second shield plate further comprises:

a first finger extending from an edge of the second shield plate;

a second finger adjacent to the first finger and extending from the edge of the second shield plate, thereby forming a channel between the first finger and the second finger; and a coupling disposed within the channel adjacent the first finger, the coupling including, a contact, a first flexible connecting arm extending from a first end of the contact to a first portion of the first finger, and a second flexible connecting arm extending from a second end of the contact to a second portion of the first finger, wherein the contact is separated from the first finger by an opening, wherein the first flexible connecting arm and the second flexible connecting arm are configured to allow the contact to elastically flex both toward and away from the first finger, and wherein the first flexible connecting arm and the second flexible connecting arm provide at least two current paths from the contact to the first finger.

11. An electrical connector according to claim 10, wherein the contact further comprises a deflecting portion extending from the contact and turned toward the first flexible connecting arm.

12. An electrical connector according to claim 10, wherein the contact further comprises a protrusion disposed on the contact.

13. An electrical connector according to claim 10, wherein the coupling is a plurality of couplings.

14. An electrical connector assembly, the electrical connector assembly comprising:

a first wafer, the first wafer including, a first shield plate, a first finger extending from an edge of the first shield plate, a second finger adjacent to the first finger and extending from the edge of the first shield plate, thereby forming a first channel between the first finger and the second finger, and a first coupling disposed within the first channel adjacent the first finger, the first coupling including, a first contact, a first flexible connecting arm extending from a first end of the first contact to a first portion of the first finger, and a second flexible connecting arm extending from a second end of the first contact to a second portion of the first finger;

a second wafer disposed adjacent the first wafer, the second wafer including, a second shield plate, a third finger extending from an edge of the second shield plate, a fourth finger adjacent to the third finger and extending from the edge of the second shield plate, thereby forming a second channel between the third finger and the fourth finger, and a second coupling disposed within the second channel adjacent the third finger, the second coupling including, a second contact, a third flexible connecting arm extending from a first end of the second contact to a first portion of the third finger, and a fourth flexible connecting arm extending from a second end of the second contact to a second portion of the third finger;

a third shield received in the first channel and the second channel and engaging the first contact and the second contact; and a fourth shield disposed transverse to the third shield, wherein the first contact is separated from the first finger by an opening, wherein the first flexible connecting arm and the second flexible connecting arm are configured to allow the first contact to elastically flex both toward and away from the first finger, wherein the first flexible connecting arm and the second flexible connecting arm provide at least two current paths from the first contact to the first finger, wherein the second contact is separated from the third finger by an opening wherein the third flexible connecting arm and the fourth flexible connecting arm are configured to allow the second contact to elastically flex both toward and away from the third finger, and wherein the third flexible connecting arm and the fourth flexible connecting arm provide at least two current paths from the second contact to the third finger.

15. An electrical connector assembly according to claim 14, wherein the first wafer further comprises:

a plurality of first shield couplings disposed in pairs along an edge of the first shield plate to form a first column of first shield couplings, and a plurality of first signal conductors disposed adjacent the first shield plate between respective pairs of first shield couplings, wherein the second wafer further comprises:

a plurality of second shield couplings disposed along an edge of the second shield plate to form a second column of second shield couplings parallel to the first column of first shield couplings, and a plurality of second signal conductors disposed in pairs adjacent the second shield plate, and wherein at least one of the pair of first shield couplings is adjacent to one of the plurality of first signal conductors and at least one of the plurality of second signal conductors and at least one of the plurality of second shield couplings is adjacent to one of the plurality of second signal conductors and at least one of the plurality of first signal conductors.

16. An electrical connector according to claim 14, wherein the first contact further comprises a deflecting portion extending from the first contact and turned toward the first flexible connecting arm.

17. An electrical connector according to claim 14, wherein the first contact her comprises a protrusion disposed on the first contact.

18. An electrical connector according to claim 14, wherein the second contact further comprises a deflecting portion extending from the second contact and tamed toward the third flexible connecting arm.

19. An electrical connector according to claim 14, wherein the second contact further comprises a protrusion disposed on the second contact.

20. An electrical connector, the electrical connector comprising:

a shield plate;

a first finger extending from an edge of the shield plate;

a second finger adjacent to the first finger and extending from the edge of the shield plate, thereby forming a channel between the first finger and the second finger; and a coupling disposed within the channel adjacent the first finger, the coupling including, a contact, a first flexible connecting arm extending from a first end of the contact to the first finger, and a second flexible connecting arm extending from a second end of the contact to the edge of the shield plate in the channel, wherein the contact is separated from the first finger by an opening, wherein the first flexible connecting arm and the second flexible connecting arm are configured to allow the contact to elastically flex both toward and away from the first finger, and wherein the first flexible connecting arm and the second flexible connecting arm provide at least two current paths from the contact to the shield plate.

21. An electrical connector according to claim 20, wherein the contact further comprises a deflecting portion extending from the contact and turned toward the first flexible connecting arm.

22. An electrical connector according to claim 20, wherein the contact further comprises a protrusion disposed on the contact.

23. An electrical connector according to claim 20, wherein the coupling further comprises:

a second contact;

a third flexible connecting arm extending from a first end of the second contact to the second finger; and a fourth flexible connecting arm extending from a second end of the second contact to the edge of the shield plate in the channel, wherein the second contact is separated from the second finger by an opening, wherein the third flexible connecting arm and the fourth flexible connecting arm are configured to allow the second contact to elastically flex both toward and away from the second finger, and wherein the third flexible connecting arm and the fourth flexible connecting arm provide at least two current paths from the second contact to the shield plate.

24. An electrical connector according to claim 20, further comprising a signal conductor disposed adjacent the shield plate and the first finger.

* * * * *